US008469357B2

(12) United States Patent
Furusawa

(10) Patent No.: US 8,469,357 B2
(45) Date of Patent: Jun. 25, 2013

(54) IMAGE FORMING APPARATUS WITH MOVING FIRST AND SECOND REGULATING MEMBERS

(75) Inventor: Motohiro Furusawa, Suntou-gun (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/311,868

(22) Filed: Dec. 6, 2011

(65) Prior Publication Data

US 2012/0074642 A1 Mar. 29, 2012

Related U.S. Application Data

(63) Continuation of application No. 12/473,976, filed on May 28, 2009, now Pat. No. 8,136,809.

(30) Foreign Application Priority Data

May 29, 2008 (JP) ..... 2008-140493

(51) Int. Cl.
*B65H 1/00* (2006.01)
*B65H 1/04* (2006.01)

(52) U.S. Cl.
CPC ..... *B65H 1/04* (2013.01)
USPC ..... 271/171

(58) Field of Classification Search
USPC ..... 271/171
See application file for complete search history.

(56) References Cited

U.S. PATENT DOCUMENTS

| | | | | |
|---|---|---|---|---|
| 7,922,171 | B2 * | 4/2011 | Kawamura et al. | 271/171 |
| 2006/0244203 | A1 | 11/2006 | Kirby et al. | |
| 2009/0072471 | A1 * | 3/2009 | Rowe et al. | 271/171 |

FOREIGN PATENT DOCUMENTS

| | | | |
|---|---|---|---|
| JP | 2001-097561 | A | 4/2001 |
| JP | 2006341973 | A | 12/2006 |
| JP | 4438695 | B2 | 3/2010 |

OTHER PUBLICATIONS

JP OA issued Sep. 18, 2012 for corresponding JP 2008-140493 (English Translation provided).

* cited by examiner

*Primary Examiner* — Gerald McClain
(74) *Attorney, Agent, or Firm* — Rossi, Kimms & McDowell LLP

(57) ABSTRACT

A trailing end of a sheet stored in a cassette body is regulated by a first trailing end regulating member and a second trailing end regulating member. The first trailing end regulating member is provided to be slid in a cassette case where the sheet is stored, and the second trailing end regulating member is provided in the first trailing end regulating member to be slid. In addition, at positions according to a size of the sheet that is stored in the cassette case, the first trailing end regulating member is held by a first holding portion and the second trailing end regulating member is held by a second holding portion. In addition, holding of the first trailing end regulating member by the first holding portion and holding of the second trailing end regulating member by the second holding portion are released by the operation of a trailing end regulating lever.

5 Claims, 23 Drawing Sheets

IMAGE FORMING APPARATUS WITH MOVING FIRST AND SECOND REGULATING MEMBERS

CROSS REFERENCE TO RELATED APPLICATION

This application is a continuation of and claims benefit to U.S. patent application Ser. No. 12/473,976, filed May 28, 2009, the entire content of which is hereby incorporated herein by reference. This application and the '976 application claim priority to JP Application No. 2008-140493, filed May 29, 2008.

BACKGROUND OF THE INVENTION

1. Field of the Invention

The present invention relates to an image forming apparatus, and more particularly, to an image forming apparatus that provides a trailing end regulating member to be separated from a cassette body of a sheet cassette that stores sheets.

2. Description of the Related Art

In general, each of image forming apparatuses, such as a copying machine, a printer, and a facsimile, includes a sheet feeding apparatus. In this image forming apparatus, a sheet is fed from the sheet feeding apparatus to an image forming portion and an image is formed on the sheet by the image forming portion. The sheet feeding apparatus is generally configured as follows. A sheet cassette serving as a sheet storage portion is mounted in an image forming apparatus body to be drawn therefrom, and sheets stored in the sheet cassette is automatically fed to the image forming portion by a sheet feeding roller.

In this case, a cassette body where sheets of the sheet cassette are stored is provided with a trailing end regulating member. When a sheet that has a smaller size than a sheet having a maximum size where the sheet can be stored is stored, the trailing end regulating member regulates a position of an end of the stored sheet at an upstream side of a sheet feeding direction (hereinafter, simply referred to as a trailing end). Further, the sheet cassette body is provided with a side end regulating member that regulates a position of a side end of the sheet in a direction orthogonal to the sheet feeding direction (hereinafter, referred to as width-wise direction).

In addition, in the sheet cassette, the position of the side end of the sheet is regulated by the side end regulating member. Meanwhile, the trailing end of the sheet is regulated by the trailing end regulating member, such that a position of the tip of the sheet is always regulated to a predetermined sheet feedable position. As a result, when the sheet cassette is mounted in the image forming apparatus body, each sheet can be stably fed without depending on the size of each sheet.

In recent years, in order to improve spatial efficiency, the image forming apparatus has been miniaturized. However, when the image forming apparatus is miniaturized, due to the used sheet, that is, the sheet cassette, the image forming apparatus body may be shortened. In this case, if the sheet cassette is mounted in the image forming apparatus body, the sheet cassette may protrude from the image forming apparatus body, which results in deteriorating spatial efficiency.

Accordingly, in order to resolve the above-described problem, for example, Japanese Patent Application Laid-Open No. 2001-97561 discloses an expanding/contracting sheet cassette in which a trailing end regulating member is provided to be drawn from a cassette body and drawn in accordance with a size of a sheet.

In this case, in the expanding/contracting sheet cassette, the cassette body is formed to have a size smaller than or equal to a size of the image forming apparatus body. In addition, when a sheet that has a size larger than the size of the cassette body is stored, the trailing end regulating member is drawn by the amount of protrusion of the sheet from the image forming apparatus body.

In the sheet cassette according to the related art that has the above-described structure, the trailing end regulating member is locked by a locking member at the drawn position or a storage position. When the trailing end regulating member is drawn or the sheet is stored, locking of the locking member is released.

Further, in order to store a sheet having a small size in the sheet cassette, the trailing end regulating member is divided into two parts. That is, one of the two parts is used as a trailing end regulating member for a large size and the other is used as a trailing end regulating member for a small size. Further, the cassette body is provided with a middle plate needed to press the sheet by the sheet feeding roller. However, in the middle plate, a slit is provided to enable a movement of the trailing end regulating member for the small size. In addition, the trailing end regulating member for the small size is provided to have a size smaller than a size of the trailing end regulating member for the large size, such that the trailing end regulating member of the small size can move in the slit.

FIG. 22 is a perspective view illustrating an expanding/contracting sheet cassette according to the related art. In FIG. 22, an expanding/contracting sheet cassette 102, a cassette body 103, and a first trailing end regulating member 104 are illustrated. In this case, the first trailing end regulating member 104 is provided in the cassette body 103 to be slid. The first trailing end regulating member 104 includes a locking member (not illustrated) that locks the first trailing end regulating member 104 to the cassette body 103, and a locking releasing lever 106 that releases locking by the locking member and is used for the first trailing end regulating member.

A second trailing end regulating member 105 for a small size is provided in the first trailing end regulating member 104 to be slid. The second trailing end regulating member 105 includes a locking member (not illustrated) that locks the second trailing end regulating member 105 to the cassette body 103 and a locking releasing lever 107 that releases locking by the locking member and is used for the second trailing end regulating member. A middle plate 108 is provided in the cassette body 103 to rotate in an upward-to-downward direction. The middle plate 108 is provided with a slit 108*a* where the second trailing end regulating member 105 enters.

In addition, when the sheet is stored in the sheet cassette 102, locking of the first and second trailing end regulating members 104 and 105 are released by the locking releasing levers 106 and 107, and the first and second trailing end regulating members 104 and 105 are moved to positions according to the size of the sheet.

For example, when a sheet having a small size is stored, only the second trailing end regulating member 105 enters into a slit that is formed in the middle plate 108, as illustrated in FIG. 23A. Further, when a sheet having a large size is stored, the first and second trailing end regulating members 104 and 105 are drawn from the cassette body 103, as illustrated in FIG. 23B.

However, in the image forming apparatus according to the related art that includes the sheet cassette, works for moving the two trailing end regulating members 104 and 105 are independently performed. For this reason, when a sheet that has a size different from the size of the sheets stored until now is stored in the sheet cassette, it is needed to operate both the first trailing end regulating member 104 and the second trailing end regulating member 105 after releasing locking.

That is, in the sheet cassette according to the related art, when the size of the sheet is changed, a user needs to operate the two locking releasing levers 106 and 107 to perform expanding/contracting operations of the first and second trailing end regulating members 104 and 105, which results in lowering usability.

Accordingly, the present invention provides an image forming apparatus that can improve usability.

SUMMARY OF THE INVENTION

The present invention provides an image forming apparatus. The image forming apparatus includes a sheet feeding apparatus that feeds a sheet stored in a sheet cassette and an image forming portion that forms an image on the sheet transmitted by the sheet feeding apparatus. The sheet cassette includes a cassette body that stores the sheet, a first regulating member that is provided in the cassette body to be slid in a forward-to-backward direction and regulates a trailing end of the sheet stored in the cassette body, a second regulating member that is provided in the first regulating member to be slid in a forward-to-backward direction and regulates the trailing end of the sheet stored in the cassette body, a first holding portion that holds the first regulating member in the cassette body, a second holding portion that holds the second regulating member in the first regulating member, and a common releasing portion that is operated when the first regulating member and the second regulating member are moved to trailing end regulation positions according to a size of the stored sheet and releases holding of the first regulating member by the first holding portion and holding of the second regulating member by the second holding portion. The common releasing portion has an operation portion that releases holding of the first holding portion and the second holding portion by a pressing operation in a direction that slidably moves the first regulating member and the second regulating member.

According to an embodiment of the present invention, the common releasing unit is operated, and the first and second regulating members can be moved by releasing holding of the first regulating member by a first holding mechanism and holding of the second regulating member by a second holding mechanism. Therefore, it is possible to improve usability.

Further features of the present invention will become apparent from the following description of exemplary embodiments with reference to the attached drawings.

DESCRIPTION OF THE EMBODIMENTS

Hereinafter, exemplary embodiments of the present invention will be described in detail with reference to the accompanying drawings.

Figure 1:
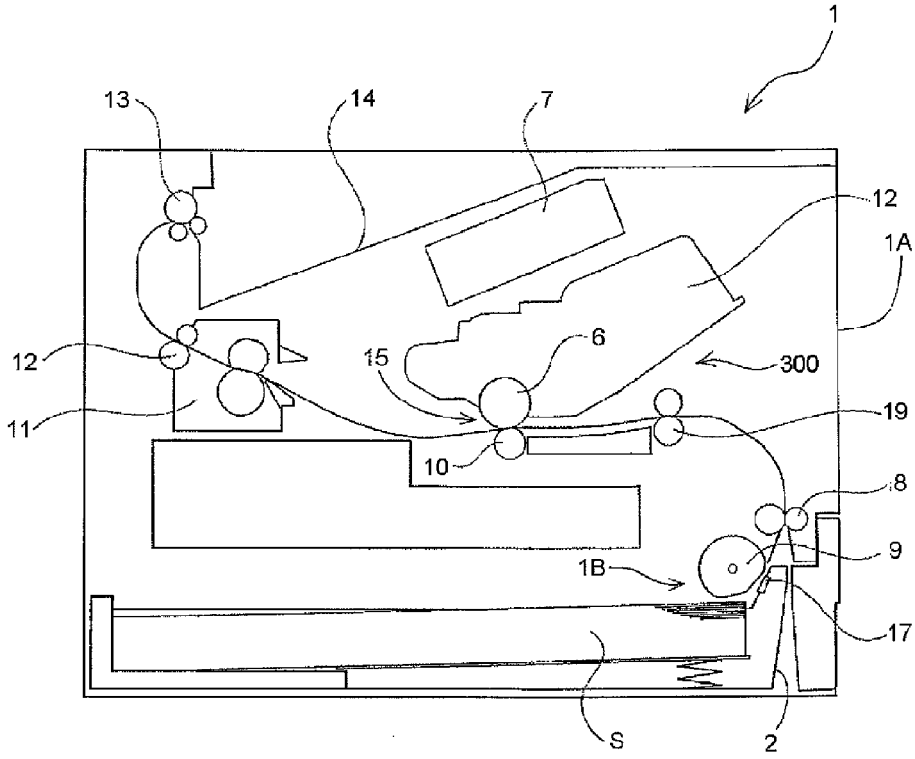
FIG. 1 is a diagram illustrating the schematic configuration of a laser beam printer that is an example of an image forming apparatus including a sheet feeding apparatus according to a first embodiment of the present invention.

FIG. 1 is a diagram illustrating the schematic configuration of a laser beam printer that is an example of an image forming apparatus including a sheet feeding apparatus according to a first embodiment of the present invention.

In FIG. 1, a laser beam printer 1 has a laser beam printer body 1A (hereinafter, referred to as printer body). Further, the laser beam printer 1 has a photosensitive drum 6 where a latent image is formed by a scanner unit 7, a development device (not illustrated) that develops the latent image using a toner to form a toner image in the photosensitive drum 6, and a process cartridge 112 that integrally includes a cleaner. In addition, an image forming portion 300 is formed using the photosensitive drum 6 and the development device (not illustrated).

Further, the laser beam printer 1 includes a sheet cassette 2 that is mounted to be detachably attached from the printer body 1A, a sheet feeding roller 9 that feeds a sheet S stored in the sheet cassette 2, and a sheet feeding apparatus 1B that feeds the sheet S to the image forming portion 300.

In addition, when an image is formed on the sheet S, the sheet S is transmitted to the image forming portion 300 by the sheet feeding roller 9 that serves as a sheet feeding member. First, the sheet S that is transmitted by the sheet feeding roller 9 is separated and fed one by one by a separation portion including the sheet feeding roller 9 and a friction plate 17, and is then conveyed to a pair of conveying rollers 8.

Next, the sheet S is conveyed from the pair of conveying rollers 8 to a pair of registration rollers 19, subjected to skew feeding correction by the pair of registration rollers 19, and conveyed to a transfer portion 15 formed by a transfer roller 10 and the photosensitive drum 6 at predetermined timing. In addition, in the transfer portion 15, the toner image that has been formed on the photosensitive drum 6 is transferred by the transfer roller 10.

Next, the sheet S where the toner image is transferred is conveyed to a fixer 11 and heated and pressurized by the fixer 11. As a result, the toner image is fixed. Subsequently, the sheet S is discharged to a sheet discharge tray 14 by a lower sheet discharge roller 12 and an upper sheet discharge roller 13.

Figure 2:
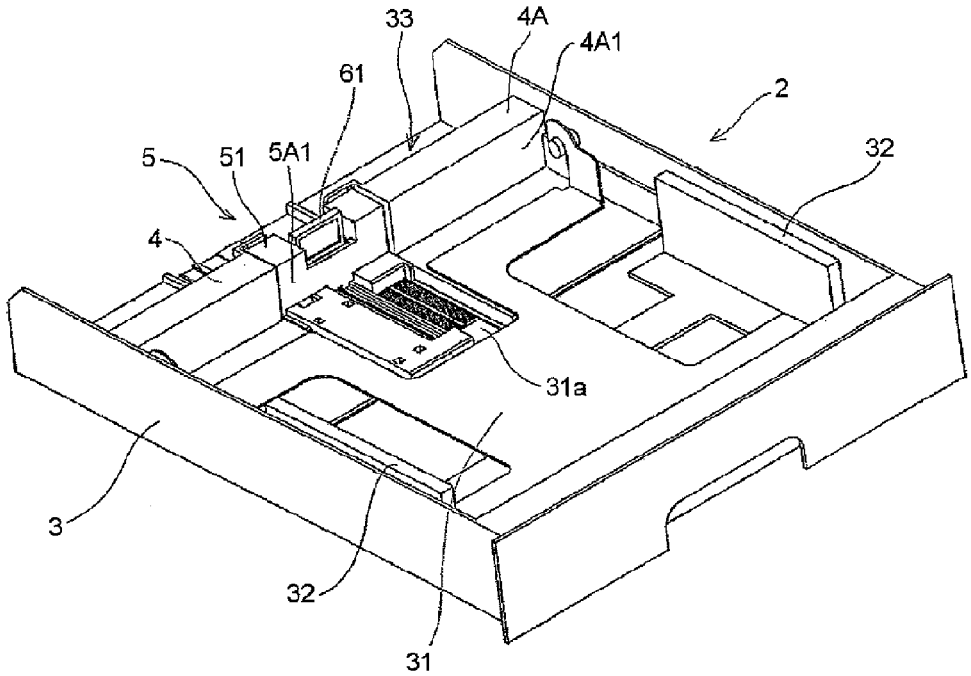
FIG. 2 is a perspective view illustrating the configuration of a sheet cassette that is provided in the sheet feeding apparatus.

Meanwhile, as illustrated in FIG. 2, the sheet cassette 2 includes a cassette case 3 that constitutes the cassette body where the sheets are stored, a middle plate 31 that is rotatably provided in the cassette case 3 in an upward-to-downward direction, a width regulating plate 32, and a trailing end regulating plate 33. The middle plate 31 stacks the sheet, rotates in an upward-to-downward direction at the time of feeding the sheet, presses the sheet S by the sheet feeding roller 9, and supports a sheet feeding operation. The middle plate 31 is provided with a slit 31*a* that a second trailing end regulating member (a second regulating member) 5 (which will be described in detail below) enters.

The width regulating plate 32 regulates a position of an end of the sheet in a width-wise direction, when the sheet is stored. Further, the trailing end regulating plate 33 regulates a position of a trailing end of the sheet, and includes a first trailing end regulating member (a first regulating member) 4 and a second trailing end regulating member 5.

Figure 3:
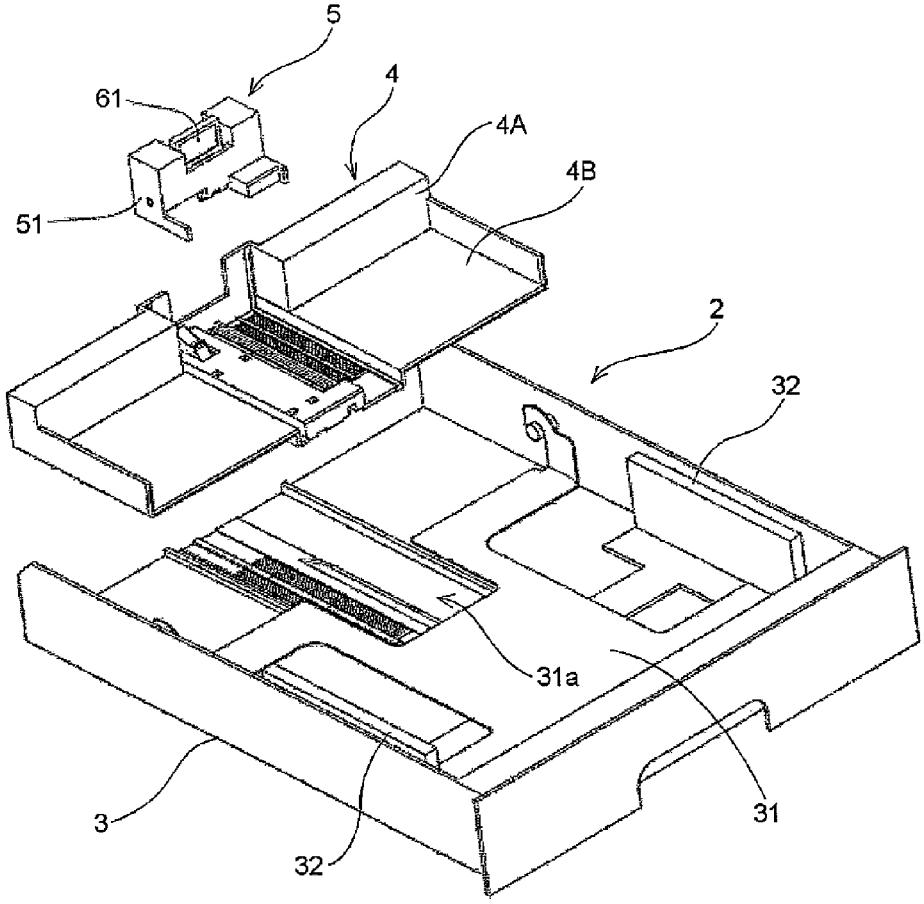
FIG. 3 is an exploded perspective view illustrating a trailing end regulating plate, a first trailing end regulating member, and a second trailing end regulating member that are provided in the sheet cassette.

As illustrated in FIG. 3, the first trailing end regulating member 4 includes a body 4A that abuts the trailing end of the sheet and a supporting surface 4B that supports a portion of the trailing end of the sheet. In addition, the first trailing end regulating member 4 is mounted in the cassette case 3 to be slid in a forward-to-backward direction. Further, the second trailing end regulating member 5 is provided at a center portion of the first trailing end regulating member 4 in a width-wise direction to be slid in a forward-to-backward direction with respect to the first trailing end regulating member 4.

In addition, when the sheet is stored in the sheet cassette 2, the width regulating plate 32 and the trailing end regulating plate 33 are moved to positions according to the size of the sheet, and an end of the sheet is regulated by the width regulating plate 32. Meanwhile, the trailing end of the sheet is regulated by the first and second trailing end regulating members 4 and 5. As a result, it is possible to stably feed an arbitrary sheet without depending on the size of the sheet.

Figure 4:
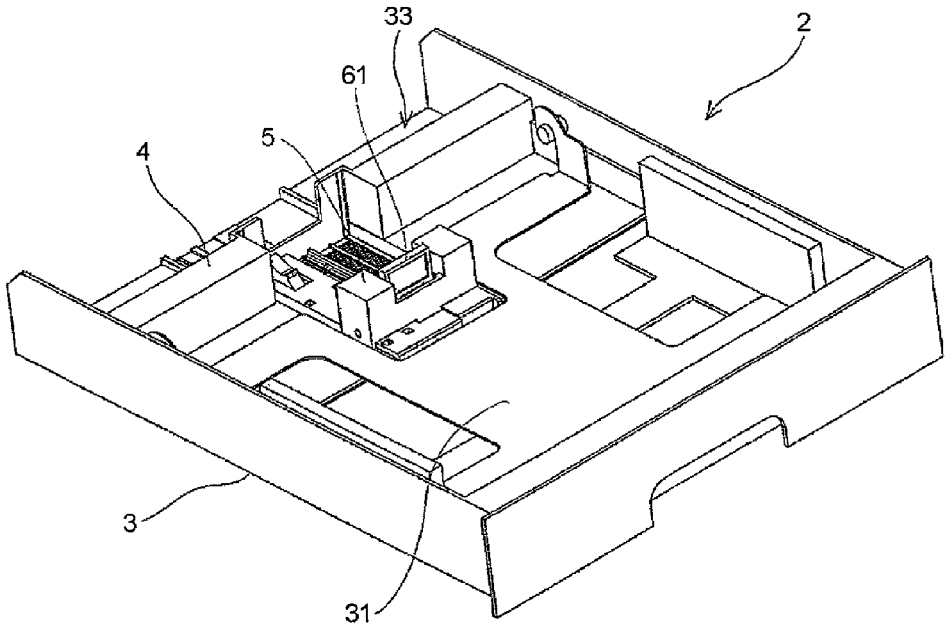
FIG. 4 is a diagram illustrating a trailing end regulation position of the second trailing end regulating member, when a sheet having a size smaller than a length of a middle plate in a sheet feeding direction is stored in the sheet cassette.

FIG. 2 illustrates positions of the first and second trailing end regulating members 4 and 5 when a trailing end of a sheet having a large size is regulated. FIG. 4 illustrates a position of the second trailing end regulating member 5, when a trailing end of a sheet, which has a size smaller than a predetermined size shorter than a length of the middle plate 31 in a sheet feeding direction, for example, an A5 size, is regulated. In this case, the trailing end of the sheet is regulated by inserting the second trailing end regulating member 5 into the slit 31*a* that is formed in the middle plate 31.

Meanwhile, as described above, the first trailing end regulating member 4 can be slid with respect to the cassette case 3. In addition, when the trailing end of the sheet is regulated, after moving the second trailing end regulating member 5 and the first trailing end regulating member 4 to the trailing end regulation positions, it is needed to fix (hold) the first and second trailing end regulating members 4 and 5 to the trailing end regulation positions. As such, in order to fix (hold) the first and second trailing end regulating members 4 and 5 to the trailing end regulation positions, a first fixing mechanism 2A and a second fixing mechanism 2B are provided in this embodiment.

Next, the configurations of the first and second fixing mechanisms 2A and 2B that fix the first and second trailing end regulating members 4 and 5 will be described. First, the configuration of the first fixing mechanism 2A that fixes the first trailing end regulating member 4 will be described.

Figure 5:
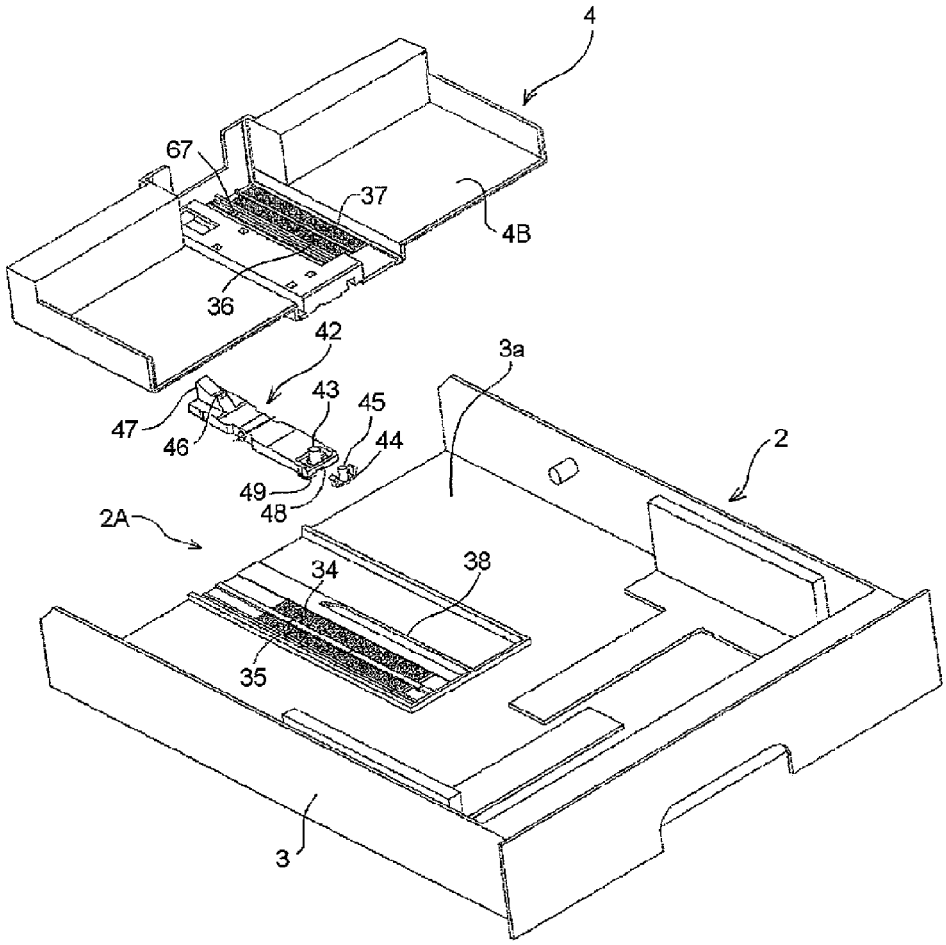
FIG. 5 is a diagram illustrating the configuration of a first fixing mechanism for fixing the first trailing end regulating member.

As illustrated in FIG. 5, the first fixing mechanism 2A is provided on a bottom surface 3*a* of the cassette case 3, and is formed using a plurality of triangle teeth. The first fixing mechanism 2A includes a first rack tooth row 34 and a second rack tooth row 35 that extend in parallel along a sheet feeding direction and serve as a first engagement unit. Further, the first fixing mechanism 2A includes a first locking member 42 serving as a first holding portion that is held in the first trailing end regulating member 4 to rotate. In this case, a bottom surface of the first locking member 42 is provided with a first tooth row 48 and a second tooth row 49. The first tooth row 48 and the second tooth row 49 are formed of triangle teeth to correspond to the first rack tooth row 34 and the second rack tooth row 35.

As in this embodiment, if each of the first and second tooth rows 48 and 49 and the first and second rack tooth rows 34 and 35 is formed of the triangle teeth, it is possible to secure mechanically high holding strength. As a result, pitches of the first and second tooth rows 48 and 49 and the first and second rack tooth rows 34 and 35 can be decreased, which results in minutely adjusting a setting position of the first trailing end regulating member 4 to an arbitrary position.

Further, in this embodiment, the tooth of each of the first tooth row 48 and the first rack tooth row 34 has a surface approximately vertical to a large size regulation direction, such that a strong resisting force is generated at the time of moving the first trailing end regulating member 4 in the large size regulation direction. In addition, when a force is applied to the first trailing end regulating member 4 in the large size regulation direction, an approximately vertical surface of each of the first tooth row 48 and the first rack tooth row 34 is welded with pressure.

As such, when a force is applied to the first trailing end regulating member 4 in the large size regulation direction, since the approximately vertical surface of each of the first tooth row 48 and the first rack tooth row 34 is welded with pressure, the first trailing end regulating member 4 can receive the force. As a result, it is possible to secure the high holding force of the first trailing end regulating member 4.

Further, the tooth of each of the second tooth row 49 and the second rack tooth row 35 has a shape that is opposite to the shape of each of the first tooth row 48 and the first rack tooth row 34. Specifically, the tooth of each of the second tooth row 49 and the second rack tooth row 35 has a surface approximately vertical to a small size regulation direction, such that a strong resisting force is generated at the time of moving the first trailing end regulating member 4 in the small size regulation direction. In addition, when a force is applied to the first trailing end regulating member 4 in the small size regulation direction, an approximately vertical surface of each of the second tooth row 49 and the second rack tooth row 35 is abutted. Therefore, the first trailing end regulating member 4 can receive the force. As a result, it is possible to secure the high holding force of the first trailing end regulating member 4.

Next, the configuration of the second fixing mechanism 2B that fixes the second trailing end regulating member 5 will be described.

Figure 6:
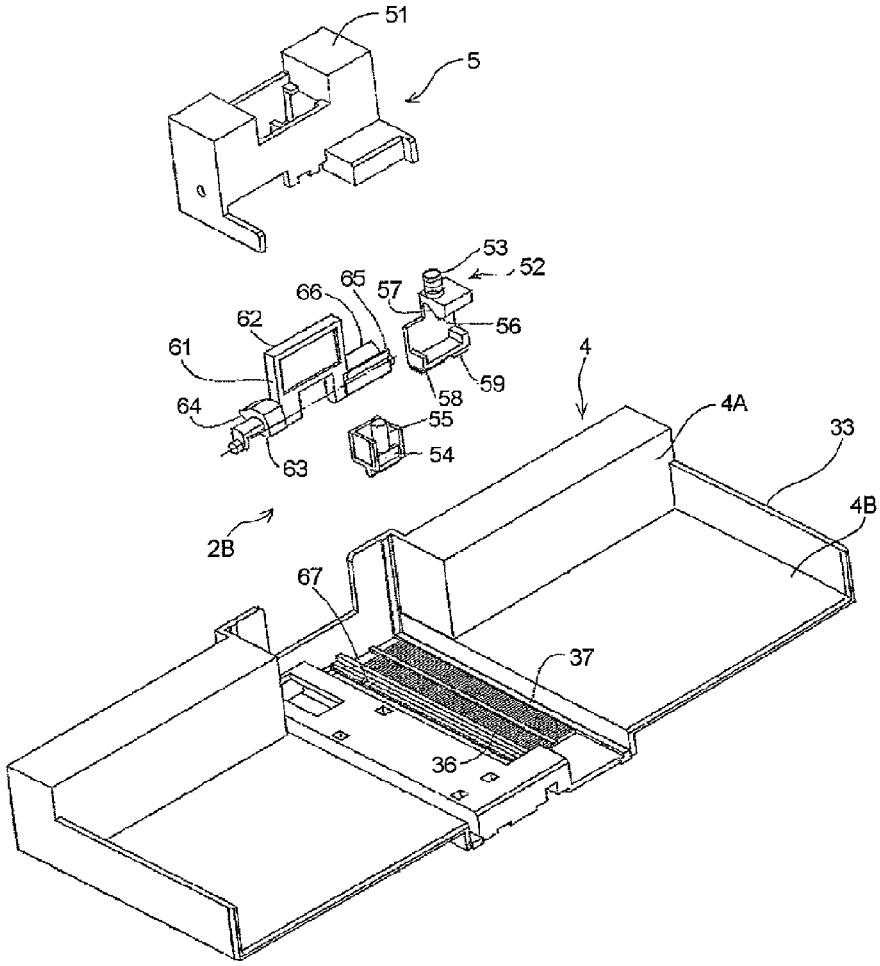
FIG. 6 is a diagram illustrating the configuration of a second fixing mechanism for fixing the second trailing end regulating member.

As illustrated in FIG. 6, the second fixing mechanism 2B is provided on a supporting surface 4B of the first trailing end regulating member 4, and is formed using a plurality of triangle teeth. The second fixing mechanism 2B includes a third rack tooth row 36 and a fourth rack tooth row 37 that extend in parallel along a sheet feeding direction and serve as a second engagement unit. Further, the second fixing mechanism 2B includes a second locking member 52 serving as a second holding portion that is held in a body 51 of the second trailing end regulating member 5 to move in an upward-to-downward direction. In this case, a bottom surface of the second locking member 52 is provided with the third tooth row 58 and the fourth tooth row 59 to correspond to the third rack tooth row 36 and the fourth rack tooth row 37.

As in this embodiment, if each of the third and fourth tooth rows 58 and 59 and the third and fourth rack tooth rows 36 and 37 is formed of the triangle teeth, it is possible to secure mechanically high holding strength. As a result, pitches of the third and fourth tooth rows 58 and 59 and the third and fourth rack tooth rows 36 and 37 can be decreased, which results in minutely adjusting a setting position of the second trailing end regulating member 5 to an arbitrary position.

Further, in this embodiment, the tooth of each of the third tooth row 58 and the third rack tooth row 36 has a surface approximately vertical to a large size regulation direction, such that a strong resisting force is generated at the time of moving the second trailing end regulating member 5 in the large size regulation direction. In addition, when a force is applied to the second trailing end regulating member 5 in the large size regulation direction, an approximately vertical surface of each of the third tooth row 58 and the third rack tooth row 36 is welded with pressure.

As such, when a force is applied to the second trailing end regulating member 5 in the large size regulation direction, since the approximately vertical surface of each of the third tooth row 58 and the third rack tooth row 36 is welded with pressure, the second trailing end regulating member 5 can receive the force. As a result, it is possible to secure the high holding force of the second trailing end regulating member 5.

Further, the tooth of each of the fourth tooth row 59 and the fourth rack tooth row 37 has a shape that is opposite to the shape of the third tooth row 58 and the third rack tooth row 36. Specifically, the tooth of each of the fourth tooth row 59 and the fourth rack tooth row 37 has a surface approximately vertical to a small size regulation direction, such that a strong resisting force is generated at the time of moving the second trailing end regulating member 5 in the small size regulation direction. In addition, when a force is applied to the second trailing end regulating member 5 in the small size regulation direction, an approximately vertical surface of each of the fourth tooth row 59 and the fourth rack tooth row 37 is abutted. Therefore, the second trailing end regulating member 5 can receive the force. As a result, it is possible to secure the high holding force of the second trailing end regulating member 5.

Further, in this embodiment, the trailing end regulating direction of the first and second trailing end regulating members 4 and 5 is the same as a direction where the sheet cassette 2 is inserted into the printer body 1. For this reason, if the sheet cassette 2 is powerfully inserted into the printer body in a state where the sheet is stored, a shock according to a capacity of the sheet is applied to the first and second trailing end regulating members 4 and 5.

Figure 7:
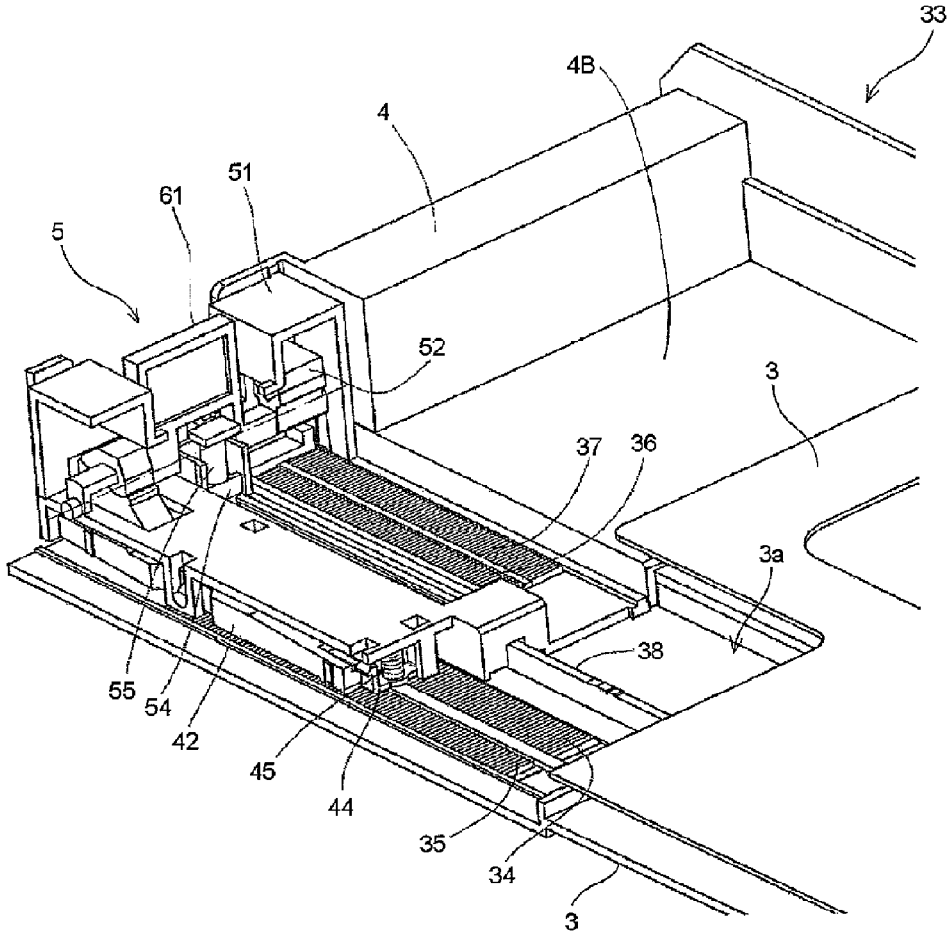
FIG. 7 is a first diagram illustrating the configurations of the first fixing mechanism and the second fixing mechanism.
Figure 8:
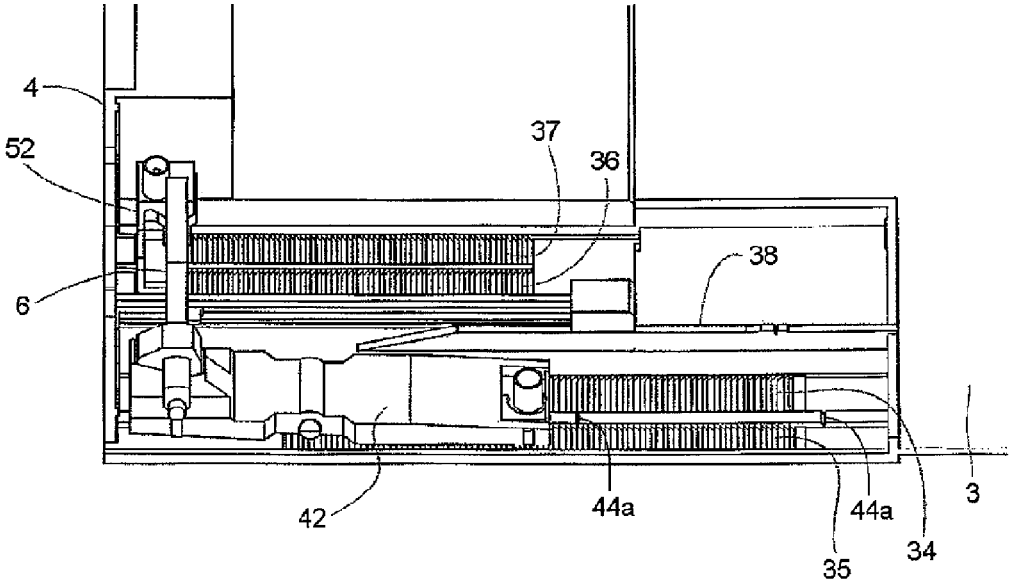
FIG. 8 is a second diagram illustrating the configurations of the first fixing mechanism and the second fixing mechanism.

At this time, if a load (shock) is differently applied to the left and right sides, the first trailing end regulating member 4 may be slightly inclined. In this case, if the first trailing end regulating member 4 is inclined, a posture of the sheets stored in the sheet cassette whose trailing end is regulated and supported by the first trailing end regulating member 4 varies. As a result, when the sheet is fed, a disadvantage, such as skew feeding and jamming, may occur. For this reason, in this embodiment where the load is made to be equally applied to the first and second trailing end regulating members 4 and 5, the first to fourth rack tooth rows 34 to 37 are disposed toward the center of a width-wise direction, as illustrated in FIGS. 7 and 8.

Figure 9A:
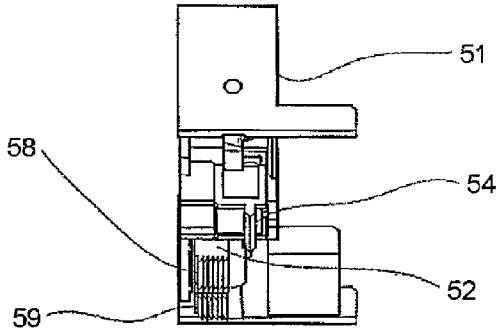
FIG. 9A is a third diagram illustrating the configuration of the second fixing mechanism.
Figure 9B:
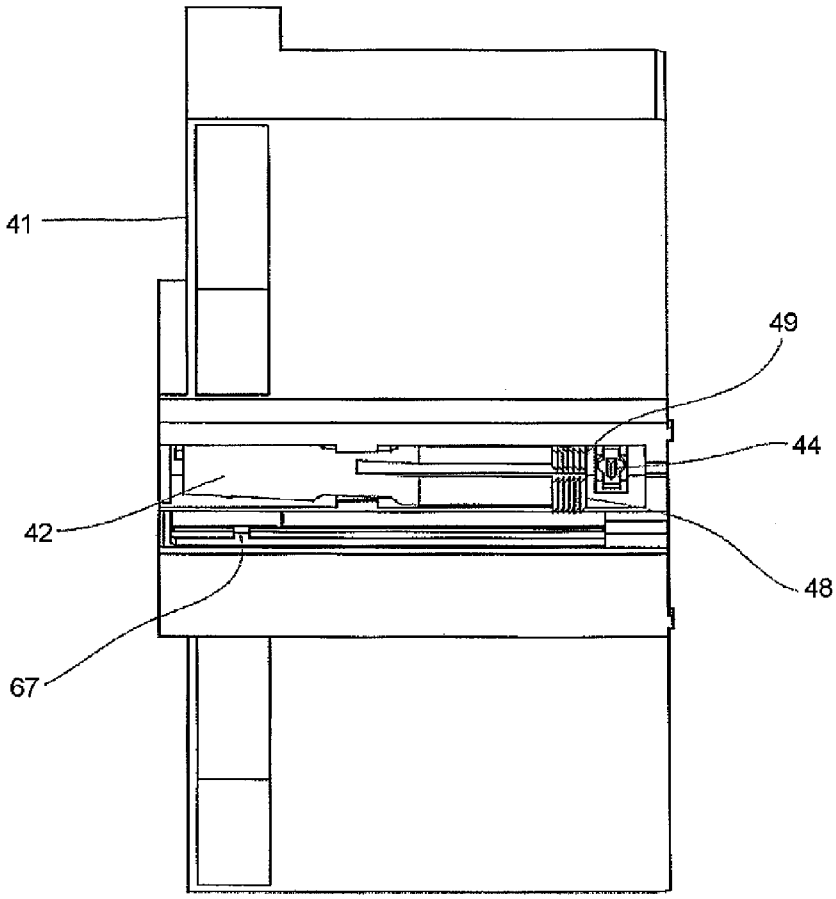
FIG. 9B is a third diagram illustrating the configuration of the first fixing mechanism.

Further, since the sheet cassette 2 is powerfully inserted into the printer body in a state where the sheet is stored, the first and fourth rack tooth rows 34 and 37 where the shock according to the storage amount of the sheet is directly applied need to have strengths stronger than those of the second and third rack tooth rows 35 and 36. Accordingly, in this embodiment, the first and fourth rack tooth rows 34 and 37 have tooth widths that are larger than those of the third and fourth rack tooth rows 35 and 36. In this case, the first tooth row 48 of the first locking member 42 and the third tooth row 58 of the second locking member 52 that are engaged with the first and fourth rack tooth rows 34 and 37 also have tooth widths that are larger than those of the second tooth row 49 and the fourth tooth row 59, as illustrated in FIG. 9.

Meanwhile, when the first and second trailing end regulating members 4 and 5 are moved, it is needed to release the fixations by the first and second fixing mechanisms 2A and 2B that have the above-described configuration. Next, the configuration for releasing the fixations of the first and second fixing mechanisms 2A and 2B will be described.

Figure 10:
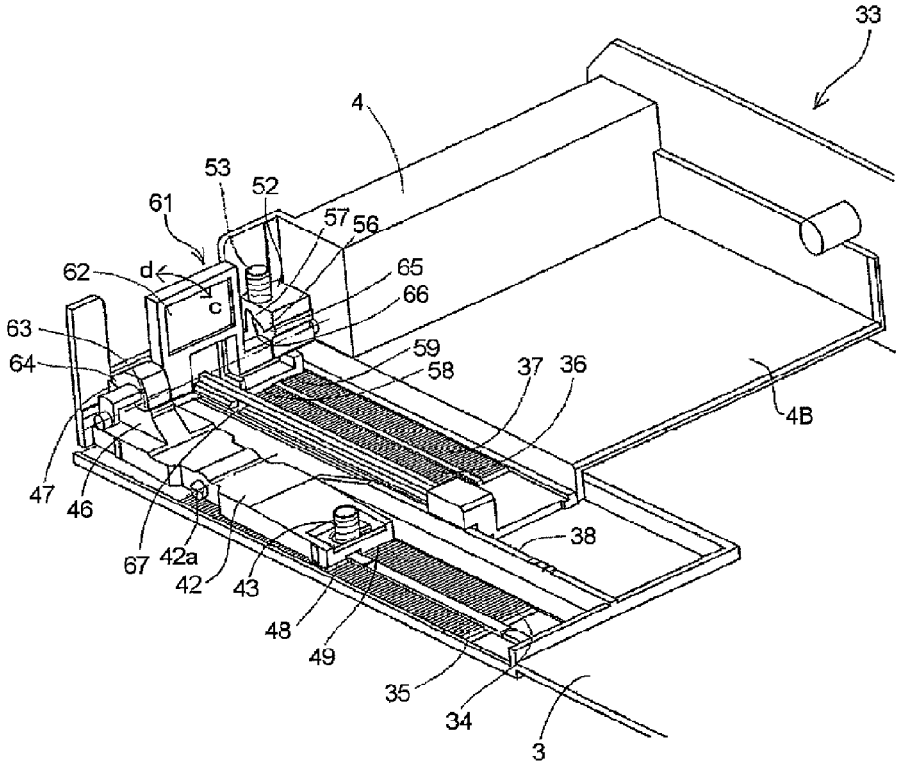
FIG. 10 is a fourth diagram illustrating the configurations of the first fixing mechanism and the second fixing mechanism.

As illustrated in FIGS. 6 and 10, a trailing end regulating lever 61 is provided in the second trailing end regulating member 5 to rotate. In this case, an operation portion 62 that a user contacts is provided on the trailing end regulating lever 61. A first cam 63 and a second cam 64 that abut the first locking member 42 and a third cam 65 and a fourth cam 66 that abut the second locking member 52 are provided below the trailing end regulating lever 61.

In FIG. 10, a first locking spring 43 is provided at a position that corresponds to the first and second tooth rows 48 and 49 of the first locking member 42. In addition, since the first locking member 42 is pushed by the first locking spring 43, the first trailing end regulating member 4 is held with respect to the cassette case 3.

Further, the first locking member 42 is disposed in the first trailing end regulating member 4 to rock around a rocking shaft 42*a* as a fulcrum. One rocking end is provided with the first and second tooth rows 48 and 49 and the other rocking end is provided with the first and second locking cams 46 and 47.

Meanwhile, below the rotation center of the trailing end regulating lever 61, a first cam 63 and a second cam 64 that have a cam shape are provided. The first cam 63 and the second cam 64 constitute a first holding releasing portion that rotates the first locking member 42 and releases locking of the first trailing end regulating member 4 by the first locking member 42.

Further, at the side of the first locking member below the trailing end regulating lever 61, the first cam 63 and the second cam 64 are provided to correspond to the first and second locking cams 46 and 47 of the first locking member 42. Further, the first locking cam 46 and the second locking cam 47 of the first locking member 42 protrude more upward than the supporting surface 4B of the first trailing end regulating member 4, such that the second trailing end regulating member 5 can be attached to or detached from the first trailing end regulating member 4, which will be described in detail below.

In FIG. 10, a second locking spring 53 biases the second locking member 52. If the force is applied to the second locking member 52 by the second locking spring 53, the second trailing end regulating member 5 is held in the first trailing end regulating member 4.

In this case, the second locking member 52 is disposed to move upward and downward with respect to the second trailing end regulating member 5. A third locking cam 56 and a fourth locking cam 57 are provided between the second locking spring 53 and the third and fourth tooth rows 58 and 59 provided at the lower end, as illustrated in FIG. 6.

Meanwhile, slightly above the rotation center of the trailing end regulating lever 61, a third cam 65 and a fourth cam 66 that have a cam shape are provided. The third cam 65 and the fourth cam 66 constitute a second holding releasing portion that descends the second locking member 52 and releases locking of the second trailing end regulating member 5 by the second locking member 52. Further, the third cam 65 and the fourth cam 66 are provided to correspond to the third locking cam 56 and the fourth locking cam 57 of the second locking member 52. At this time, the third cam 65 and the fourth cam 66 are provided such that positions (heights) of action points thereof are approximately the same.

Next, the operation of changing a state of the first trailing end regulating member 4 from a holding state to a releasing state when the first trailing end regulating member 4 moves to a position according to the size of the sheet will be described.

In this case, the operation portion 62 of the trailing end regulating lever 61 is thrown in a direction illustrated by an arrow c or d in FIG. 10. As a result, each of the cams 63 to 66 of the trailing end regulating lever 61 rotates and acts on each of the locking cams 46, 47, 56, and 57 of the corresponding first and second locking members 42 and 52. Therefore, the first and second locking members 42 and 52 move in a releasing direction from the holding positions.

Figure 11:
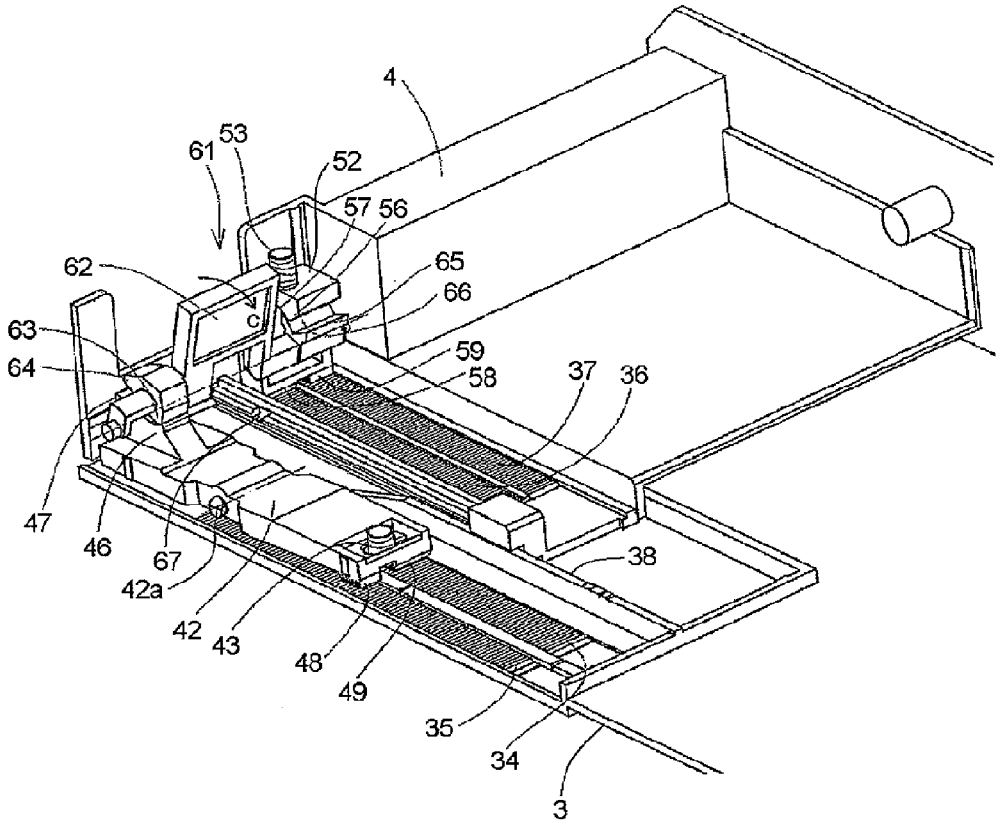
FIG. 11 is a diagram illustrating a state of when an operation portion of a trailing end regulating lever, which is provided in the second trailing end regulating member of the sheet cassette, is thrown in a direction illustrated by an arrow c.

For example, as illustrated in FIG. 11, when the operation portion 62 of the trailing end regulating lever 61 is thrown in a direction illustrated by the arrow c, the trailing end regulating lever 61 rotates around a rotation shaft, and the first cam 63 of the trailing end regulating lever 61 pushes down the first locking cam 46 of the first locking member 42.

Thereby, the first locking member 42 rocks around a rocking shaft 42*a* in a holding releasing direction while being against a pressing force of the first locking spring 43, and the first and second tooth rows 48 and 49 that are provided opposite to the first locking member 42 with the rocking shaft 42*a* therebetween are pushed up. As a result, engagement of the first and second tooth rows 48 and 49 of the first locking member 42 and the first and second rack tooth rows 34 and 35 of the cassette case 3 is released, and the state of the first trailing end regulating member 4 is changed from the holding state to the releasing state, with respect to the cassette case 3.

At the same time, in regards to the second trailing end regulating member 5, since the third cam 65 of the trailing end regulating lever 61 pushes up the third locking cam 56 of the second locking member 52, the second locking member 52 is pushed up in an upward direction as a holding releasing direction while being against the pressing force of the second locking spring 53. As a result, engagement of the third and fourth tooth rows 58 and 59 of the second locking member 52 and the third and fourth rack tooth rows 36 and 37 of the first trailing end regulating member 4 is released, and the state of the second trailing end regulating member 5 is changed from the holding state to the releasing state, with respect to the first trailing end regulating member 4.

Figure 12:
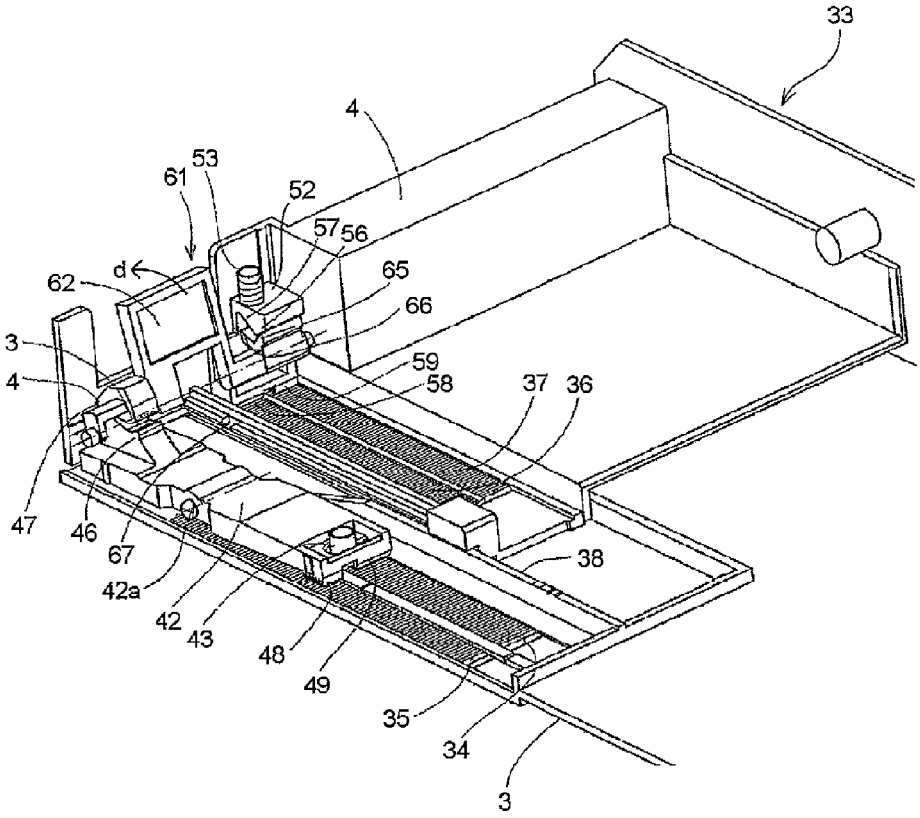
FIG. 12 is a diagram illustrating a state of when an operation portion of a trailing end regulating lever, which is provided in the second trailing end regulating member of the sheet cassette, is thrown in a direction illustrated by an arrow d.

Meanwhile, as illustrated in FIG. 12, when the operation portion 62 of the trailing end regulating member 61 is thrown in a direction illustrated by the arrow d, the trailing end regulating lever 61 rotates around a rotation shaft, and the second cam 64 of the trailing end regulating lever 61 pushes down the second locking cam 47 of the first locking member 42.

Thereby, the first locking member 42 rocks around a rocking shaft 42*a* while being against the pressing force of the first locking spring 43, and the first and second tooth rows 48 and 49 are pushed up. As a result, engagement of the first and second tooth rows 48 and 49 of the first locking member 42 and the first and second rack tooth rows 34 and 35 of the cassette case 3 is released, and the state of the first trailing end regulating member 4 is changed from the holding state to the releasing state, with respect to the cassette case 3.

At the same time, in regards to the second trailing end regulating member 5, since the fourth cam 66 of the trailing end regulating lever 61 pushes up the fourth locking cam 57 of the second locking member 52, the second locking member 52 is pushed up while being against the pressing force of the second locking spring 53. As a result, engagement of the third and fourth tooth rows 58 and 59 of the second locking member 52 and the third and fourth rack tooth rows 36 and 37 of the first trailing end regulating member 4 is released, and the state of the second trailing end regulating member 5 is changed from the holding state to the releasing state, with respect to the first trailing end regulating member 4.

Further, if the trailing end regulating lever 61 is excessively thrown, there occur problems in the contact and separation operations of all the engaging portions and the motions of all the corresponding cam portions. Accordingly, the amount that a user throws the trailing end regulating lever 61 is set to the proper thrown amount by means of a stopper (not illustrated) that enables the trailing end regulating lever to be properly thrown. Further, in the case where the trailing end regulating lever 61 is thrown, that is, the first and second trailing end regulating members 4 and 5 become a releasing state, if the user lets the trailing end regulating lever 61 go, due to the pressing forces of the first and second locking springs 43 and 53, the trailing end regulating lever 61 is automatically returned to the original position. As a result, the first and second trailing end regulating members 4 and 5 are returned to the holding state at the moved positions.

As described above, in this embodiment, regardless of the direction where the operation portion 62 of the trailing end regulating lever 61 serving as the common releasing portion that is a unique user operation portion is thrown, both the first trailing end regulating member 4 and the second trailing end regulating member 5 can enter into a releasing state. That is, according to this embodiment, the user operates one trailing end regulating lever 61 to make the first and second trailing end regulating members 4 and 5 enter in a locking holding state or a locking releasing state. Further, the user operates one trailing end regulating lever 61 to move the first and second trailing end regulating members 4 and 5 in the same direction as the operation direction of the trailing end regulating lever 61, thereby moving the first and second trailing end regulating members 4 and 5 to the trailing end regulation positions according to the size of the sheet. Further, the user operates one trailing end regulating lever 61 to move the first and second trailing end regulating members 4 and 5 in a direction opposite to the operation direction of the trailing end regulating lever 61.

Meanwhile, as described above, in this embodiment, when the sheet is stored, it is possible to slidably move the first and second trailing end regulating members 4 and 5 to the positions according to the size of the sheet, that is, the length of the sheet in the sheet feeding direction.

In this case, when the first and second trailing end regulating members 4 and 5 are slid and the sheet has the predetermined length in the sheet feeding direction or more, the first and second trailing end regulating members 4 and 5 can be integrally slid, such that the position of the trailing end of the sheet is regulated by the first and second trailing end regulating members 4 and 5. Further, when the sheet does not have the predetermined length in the sheet feeding direction or more, that is, the sheet has the small size of the predetermined size or less, only the second trailing end regulating member 5 is slid.

In this embodiment, the sheet having the minimum size in a range where the first and second trailing end regulating members 4 and 5 can be integrally slid is used as a sheet having an A5 size, and in the case of the sheet that has the size smaller than the size of the sheet having the A5 size, only the second trailing end regulating member 5 is slid.

In this case, in the case of storing the sheet that has the size larger than the size of the sheet having the A5 size, a third locking member 54 is provided to integrate the second trailing end regulating member 5 with the first trailing end regulating member 4, such that the first and second trailing end regulating members 4 and 5 are integrally slid.

Figure 13A:
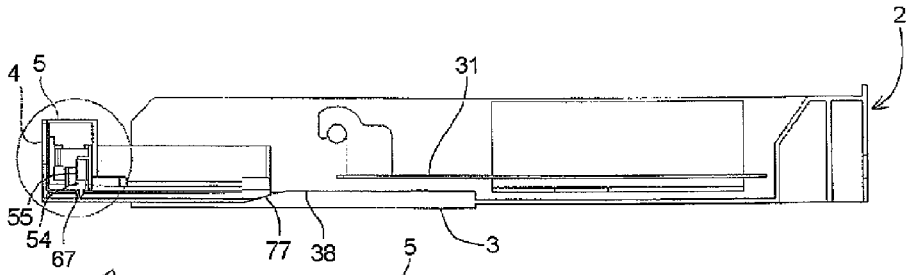
FIG. 13A is a diagram illustrating a third locking member that is provided in the second trailing end regulating member.
Figure 13B:
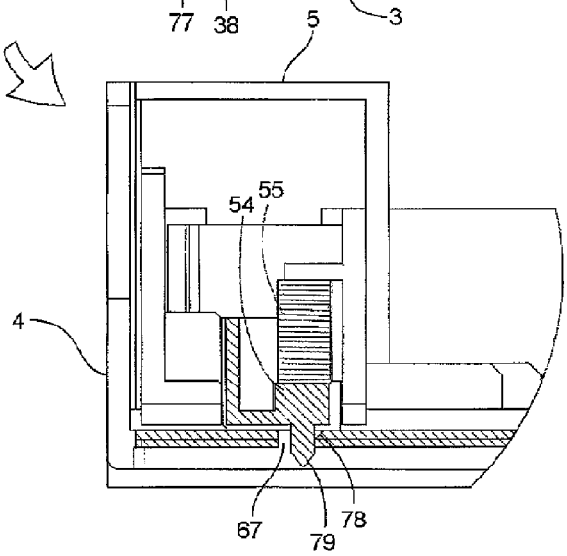
FIG. 13B is a partial enlarged view of FIG. 13A.

Further, the third locking member 54 serving as a connecting portion that connect the first and second trailing end regulating members 4 and 5 is provided to move in a direction vertical to the second trailing end regulating member 5, as illustrated in FIG. 13. In addition, the third locking member 54 has an inserting portion 79 having a protrusion shape formed at a lower end, and the inserting portion 79 is inserted into a slit portion 67 that is formed in the first trailing end regulating member 4, by means of a pressing force by the third locking spring 55 that biases to an upper end.

As a result, the second trailing end regulating member 5 is configured such that it is not deviated in a forward-to-backward direction, with respect to the first trailing end regulating member 4. Further, since the third locking member 54 is restricted in a forward-to-backward direction with respect to the second trailing end regulating member 5, the first trailing end regulating member 4 and the second trailing end regulating member 5 are integrated with each other.

Further, when the first trailing end regulating member 4 moves to the cassette case 3 in a state where the first and second trailing end regulating members 4 and 5 are integrated with each other, the user throws, in a movement direction, the operation portion 62 of the trailing end regulating lever 61 that is provided in the second trailing end regulating member 5 to rotate, as described above. Thereby, locking of the second trailing end regulating member 5 with respect to the first trailing end regulating member 4 is released at the same time as when locking of the first trailing end regulating member 4 with respect to the cassette case 3 is released.

However, even when locking of the second trailing end regulating member 5 with respect to the first trailing end regulating member 4 is released, the inserting portion 79 of the third locking member 54 is engaged with the slit portion 67 of the first trailing end regulating member 4. Therefore, the first and second trailing end regulating members 4 and 5 are integrated with each other.

For this reason, if the user pushes the trailing end regulating lever 61, the third locking member 54 is engaged with the slit portion 67 of the first trailing end regulating member 4. Therefore, the second trailing end regulating member 5 moves in a state where the second trailing end regulating member 5 is integrated with the first trailing end regulating member 4. In this case, the second trailing end regulating member 5 moves to the cassette case 3 in a state where the first and second trailing end regulating members 4 and 5 are integrated with each other, without depending on whether the movement direction of the first trailing end regulating member 4 is approximately equal to or opposite to the direction where the operation portion 62 of the trailing end regulating lever 61 is thrown.

In this embodiment, as described above, the inserting portion 79 of the third locking member 54 is inserted into the slit portion 67 of the first trailing end regulating member 4 without a deviation in a forward-to-backward direction. However, the inserting portion 79 of the third locking member 54 may be inserted into the slit portion 67 so as not to deviate in only a forward direction (sheet feeding direction), and the second trailing end regulating portion 5 may directly bump the first trailing end regulating member 4 in a backward direction. In this way, the first trailing end regulating member 4 and the second trailing end regulating member 5 may be restricted in a forward-to-backward direction and may be integrated with each other.

Meanwhile, when the sheet that has the size smaller than the size of the sheet having the A5 size is stored in the sheet cassette 2, the second trailing end regulating member 5 is separated from the first trailing end regulating member 4, such that the only the second trailing end regulating member 5 is slid on the first trailing end regulating member.

Next, the configuration where only the second trailing end regulating member 5 is slid will be described. In this embodiment, when the first trailing end regulating member 4 is slid, if the first and second trailing end regulating members 4 and 5 are integrally moved to the storage position of the sheet having the A5 size, a tip of the first trailing end regulating member 4 at the front side bumps a bump portion (not illustrated) of the cassette case 3. As a result, the first trailing end regulating member 4 cannot move to the downstream side of the sheet feeding direction, that is, the middle plate side. Hereinafter, a storage position of a sheet that has the A5 size is called an A5 storage position, a storage position of a sheet that has a size smaller than the A5 size is called a small size storage position, and a storage position of a sheet that has a size larger than the A5 size is called a large size storage position.

In this case, in order to separate the second trailing end regulating member 5 from the first trailing end regulating member 4 and enable only the second trailing end regulating member 5 to be slid, it is needed to release engagement of the third locking member 54 and the slit portion 67 of the first trailing end regulating member 4.

For this reason, in this embodiment, as illustrated in FIG. 13, the cassette case 3 is provided with a third locking releasing rib 38 serving as a connection releasing member that includes an inclined portion 77 to release locking by the third locking member 54. In addition, if the first trailing end regulating member 4 that exists at a position corresponding to the sheet having a size larger than the A5 size is slid in a trailing end regulation direction up to a position that corresponds to a sheet having a small size, the inserting portion 79 of the third locking member 54 abuts the inclined portion 77 of the third locking releasing rib 38.

Figure 14A:
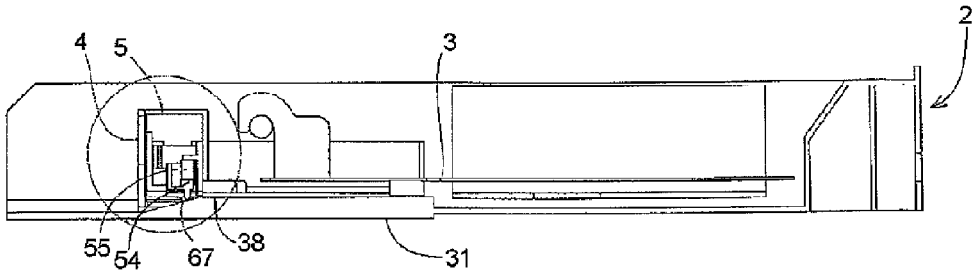
FIG. 14A is a diagram illustrating the operation of the third locking member.
Figure 14B:
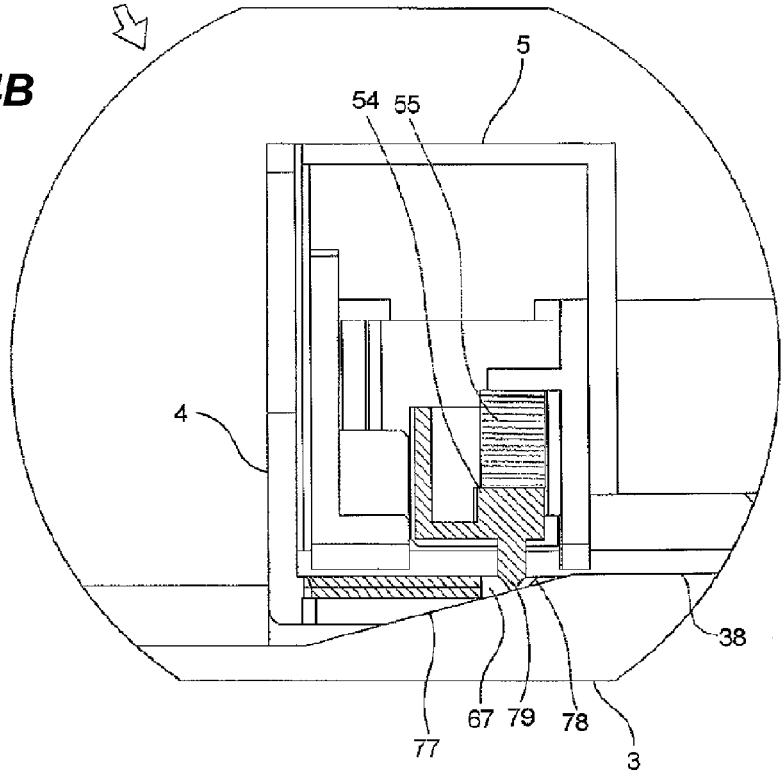
FIG. 14B is a partial enlarged view of FIG. 14A.

In this case, if the first trailing end regulating member 4 is further moved after the inserting portion 79 abuts the inclined portion 77, the third locking member 54 is pushed by the inclined portion 77 of the third locking releasing rib 38 while being against the third locking spring 55. As illustrated in FIG. 14, the third locking member 54 moves upward in the second trailing end regulating member. As a result, the inserting portion 79 of the third locking member 54 gets out of the slit portion 67 of the first trailing end regulating member 4, and the second trailing end regulating member 5 is separated from the first trailing end regulating member 4.

In this embodiment, when the third locking member 54 is engaged with the slit portion 67, as illustrated in FIG. 13, the height of an upper end surface of the third locking releasing rib 38 is set to be higher than the height of a lower end surface of the slit portion 67, thereby overlapping the third locking member and the slit portion each other in an upward-to-downward direction. As a result, the inserting portion 79 of the lower end of the third locking member 54 may easily get out of the slit portion 67 of the first trailing end regulating member 4.

Further, in order to make the inserting portion 79 of the third locking member 54 easily get out of the slit portion 67 of the first trailing end regulating member 4, the tip of the inserting portion 79 is formed in an approximately V shape. Further, a taper portion 78 that is an inclined surface for C chamfering is provided on a side end of the slit portion 67 of the first trailing end regulating member 4 in a sheet feeding direction.

In this case, in order that the V shape of the inserting portion 79 of the third locking member 54 and the taper portion 78 of the slit portion 67 do not bump each other in a state where the third locking member 54 and the slit portion 67 are engaged with each other, vertical surfaces of the inserting portion 79 and the slit portion 67 bump each other. Further, when the first trailing end regulating member 4 is at the A5 size storage position, the inclined portion 77 of the third locking releasing rib 38 is provided at a position to guide the inserting portion 79, such that the vertical surfaces of the inserting portion 79 of the third locking member 54 and the slit portion 67 do not bump each other.

The reason of such configuration is as follows. At the A5 storage position, if the vertical surfaces of the inserting portion 79 and the slit portion 67 bump each other, the inserting portion 79 cannot move upward along the inclined portion 77 of the third locking releasing rib 38, when the first trailing end regulating member 4 is moved to the small size storage position. This is because the first trailing end regulating member 4 bumps the cassette case 3 and does not move, in the above state. In this case, the third locking member 54 cannot get out of the slit portion 67 and the second trailing end regulating member 5 cannot be separated from the first trailing end regulating member 4.

Accordingly, in this embodiment, as described above, the V shape is provided in the inserting portion 79 of the third locking member 54, the taper shape is provided in the slit portion 67, and a guide portion that moves the inserting portion 79 upward is formed by the V shape and the taper shape.

In addition, when the guide portion is provided and the first trailing end regulating member 4 is moved from the large size storage position to the small size storage position, the third locking member 54 can be moved upward from the arbitrary position to the A5 storage position, by the inclined portion 77 of the third locking releasing rib 38. Further, when the third locking member 54 is moved to the small size storage position, the inserting portion 79 of the third locking member 54 that moves in a forward direction together with the second trailing end regulating member 5 is moved upward by the guide portion. As a result, the third locking member 54 gets out of the slit portion 67 of the first trailing end regulating member 4 and the second trailing end regulating member 5 is separated from the first trailing end regulating member 4.

Further, an angle (hereinafter, referred to as inclined angle $\alpha$) of the inclined portion 77 of the third locking releasing rib 38 with respect to a sliding direction (approximately horizontal direction in this embodiment) of the first trailing end regulating member 4 is set to be smaller than a V shape angle $\gamma$ of the inserting portion 79 of the third locking member 54. Further, the inclined angle $\alpha$ of the inclined portion 77 of the third locking releasing rib 38 is set to be smaller than an angle (hereinafter, referred to as taper angle $\beta$) of the taper portion 78 of the slit portion 67 with respect to a sliding direction of the first trailing end regulating member 4.

If the first trailing end regulating member 4 is moved from the large size storage position A5 to the A5 storage position, the vertical surfaces of the inserting portion 79 of the third locking member and the slit portion 67 of the first trailing end regulating member 4 contact with each other, until the position right before the A5 storage position. As a result, the first and second trailing end regulating members 4 and 5 integrally move. Then, due to the operation of the third locking releasing rib 38 of the cassette case 3 at the A5 storage position, the inserting portion 79 of the third locking member is moved more upward than the slit portion 67 of the first trailing end regulating member 4, and engagement is released.

However, when the variation in the component precision or gutter is generated, the forward movement of the inserting portion 79 of the third locking member cannot be surely made. Further, when the variation in the component precision or gutter is generated, as described above, at the A5 storage position, the vertical surfaces of the inserting portion 79 of the third locking member 54 and the slit portion 67 of the first trailing end regulating member 4 may contact with each other.

For this reason, right before the first trailing end regulating member 4 is moved from the large size storage position to the A5 storage position, the inclined portion 77 of the third locking releasing rib 38 acts and pushes up the third locking member 54. As a result, the vertical surfaces of the inserting portion 79 of the third locking member 54 and the slit portion 67 do not abut and the inclined surfaces in any one or both of them contact with each other.

At this time, since the tip of the first trailing end regulating member 4 at the front side does not reach the bump portion of the cassette case 3, the tip of the first trailing end regulating member 4 at the front side needs to surely bump the bump portion of the cassette case 3. Accordingly, in order to make the tip of the first trailing end regulating member 4 at the front side surely bump the bump portion of the cassette case 3, an angle of the inclined surfaces in any one or both of the inserting portion 79 of the third locking member 54 and the slit portion 67 of the first trailing end regulating member 4 is set to a large value.

As a result, since it is possible to make the forward movement of the third locking member 54 along the inclined portion 77 of the third locking releasing rib 38 against a pressing force of the third locking spring 55 difficult, the inserting portion 79 can push out the slit portion 67 forward, even though the vertical surfaces do not contact with each other. As a result, the first trailing end regulating member 4 can be surely moved to the bump portion of the cassette case 3. In addition, the first and second trailing end regulating members 4 and 5 can be surely moved to the A5 size storage position, in a state where the first and second trailing end regulating members 4 and 5 are integrated with each other.

Further, if the angles of the inclined surfaces of the inserting portion 79 and the slit portion 67 are set to large values, when the first and second trailing end regulating members 4 and 5 are at the A5 size storage positions and the operation portion is pushed into the small size storage position, it is possible to make the upward movement of the third locking member 54 difficult. As a result, even though the vertical surfaces do not contact with each other, the inserting portion 79 of the third locking member 54 can push out the slit portion 67 of the first trailing end regulating member 4 in a forward direction.

Hereinafter, the inclination angle $\alpha$ of the third locking releasing rib 38 will be described in detail. In this embodiment, if the first trailing end regulating member 4 is moved from the large size storage position to the small size storage position, as described above, the inserting portion 79 of the third locking member 54 abuts the inclined portion 77 of the third locking releasing rib 38. Then, if the first trailing end regulating member 4 is moved, the third locking member 54 is pushed by the inclined portion 77 of the third locking releasing rib 38 while being against the pressing force of the third locking spring 55, and moves upward in the second trailing end regulating member 5.

At this time, in order that the operation force, which is needed to move the first trailing end regulating member 4, is not stronger than that before the inserting portion 79 of the third locking member 54 abuts the inclined portion 77 of the third locking releasing rib 38, the inclination angle $\alpha$ of the third locking releasing rib 38 is set as small as possible.

However, when the first trailing end regulating member 4 is moved from the large size storage position to the peripheral portion of the A5 storage position, the vertical surfaces of the inserting portion 79 of the third locking member 54 and the slit portion 67 contact with each other and at least one of the inserting portion 79 and the slit portion 67 contacts at the inclined surface. As a result, the inserting portion 79 of the third locking member 54 easily gets out of the slit portion 67 of the first trailing end regulating member 4.

For this reason, if the V shape angle $\gamma$ of the inserting portion 79 of the third locking member 54 is set to be smaller than or approximately equal to the inclination angle $\alpha$ of the third locking releasing rib 38, the second trailing end regulating member 5 may be separated from the first trailing end regulating member 4 before the first trailing end regulating member 4 bumps the bump portion. That is, the second trailing end regulating member 5 may be separated from the first trailing end regulating member 4 before the first trailing end regulating member 4 moves to the A5 storage position.

Further, if the taper angle $\beta$ of the slit portion 67 is set to be smaller than or approximately equal to the inclination angle $\alpha$ of the third locking releasing rib 38, the second trailing end regulating member 5 may be separated from the first trailing end regulating member 4 before the first trailing end regulating member 4 bumps the bump portion of the cassette case 3.

Meanwhile, as described above, the second trailing end regulating member 5 needs to be separated from the first trailing end regulating member 4 after the tip of the first trailing end regulating member 4 at the front side surely bumps the bump portion of the cassette case 3. Accordingly, as described above, the V shape angle $\gamma$ of the inserting portion 79 of the third locking member 54 or the taper angle $\beta$ of the slit portion 67 of the first trailing end regulating member 4 is set to be larger than the inclination angle $\alpha$ of the third locking releasing rib 38.

By this configuration, the operation force that is needed in a state where the inserting portion 79 abuts the inclined portion 77 and moves in an upward direction can be made to be stronger than the operation force that moves the first trailing end regulating member 4 in a forward direction, even though the inserting portion 79 abuts the slit portion 67. As a result, it is possible to move the first trailing end regulating member 4 until the tip of the first trailing end regulating member 4 at the front side surely bumps the bump portion of the cassette case 3. Further, it is possible to integrally move the first trailing end regulating member 4 and the second trailing end regulating member 5 to the A5 storage position.

Further, when the first trailing end regulating member 4 is further moved to the small size storage position from the A5 storage position, for example, the first and second cams 63 and 64 of the trailing end regulating lever 61 illustrated in FIG. 10 and the first and second locking cams 46 and 47 of the first locking member 42 need to be separated from each other. That is, when the second trailing end regulating member 5 is separated from the first trailing end regulating member 4, the first and second cams 63 and 64 of the trailing end regulating lever 61 need to be separated from the first and second locking cams 46 and 47 of the first locking member 42.

Accordingly, in this embodiment, as illustrated in FIGS. 10 to 12, the position of the action point of the second cam 64 that is located at the upstream side of the trailing end regulating lever 61 in the sheet feeding direction is set to be higher than the position of the action point of the first cam 63 that is located at the downstream side of the trailing end regulating lever 61 in the sheet feeding direction. Further, in the same way, the position of the second locking cam 47 of the first locking member 42 is also set to be higher than the position of the first locking cam 46.

As a result, even though the first trailing end regulating member 4 is moved in a state where the user throws the operation portion 62 of the trailing end regulating lever 61 in either a c direction or a d direction, with respect to a progress direction when the second trailing end regulating member 5 is separated from the first trailing end regulating member 4, engagement due to a reverse step is decreased. As a result, when the first trailing end regulating member 4 is further moved to the small size storage position from the A5 storage position, the first and second trailing end regulating members 4 and 5 may be easily separated from each other.

By this configuration, while the first trailing end regulating member 4 is moved from the large size storage position to the small size storage position by operating the operation portion 62 of the trailing end regulating lever 61 that is mounted in the second trailing end regulating member 5, the first trailing end regulating member 4 and the second trailing end regulating member 5 can be separated from each other.

Meanwhile, when the first trailing end regulating member 4 is moved from the large size storage position to the A5 storage position, the first and second tooth rows 48 and 49 of the first locking member 42 and the first and second rack tooth rows 34 and 35 of the cassette case 3 are separated from each other.

Further, when the first trailing end regulating member 4 is moved from the A5 storage position to the small size storage position, the first and second trailing end regulating members 4 and 5 are separated from each other. For this reason, the first and second cams 63 and 64 of the trailing end regulating lever 61 are separated from the first and second locking cams 46 and 47 of the first locking member 42, which are opposite to the first and second cams 63 and 64. At this time, since the first and second tooth rows 48 and 49 of the first locking member 42 and the first and second rack tooth rows 34 and 35 of the cassette case 3 are engaged with each other, the first trailing end regulating member 4 is held in the cassette case 3 at the A5 storage position.

Further, if the operation portion 62 of the trailing end regulating lever 61 is operated, only the second trailing end regulating member 5 moves forward on the first trailing end regulating member 4 that is held in the cassette case 3. Then, the tip of the second trailing end regulating member 5 at the front side bumps a bump portion different from the first trailing end regulating member 4 that is provided in the cassette case 3 and is stopped. This state becomes a storage state of the sheet that has a minimum size in this embodiment.

Further, if the user holds the operation portion 62 of the trailing end regulating lever 61 and then lets it go, that is, the operation force that is applied to the operation portion 62 is released, the pushing up of the third and fourth locking cams 56 and 57 of the second locking member 52 by the third and fourth cams 65 and 66 of the trailing end regulating lever 61 is released. As a result, the second locking member 52 descends due to the pressing force applied to the lower side of the second locking spring 53.

As a result, the third and fourth tooth rows 58 and 59 provided at the lower end of the second locking member 52 are engaged with the third and fourth rack tooth rows 36 and 37 provided in the first trailing end regulating member 4 that is engaged with the cassette case 3, and the second trailing end regulating member 5 is held with respect to the first trailing end regulating member 4.

As such, even in the storage state of the sheet that has the minimum size, that is, a state where the first trailing end regulating member 4 and the second trailing end regulating member 5 are separated from each other, the first and second trailing end regulating members 4 and 5 can be held with respect to the cassette case 3.

Next, the operation of changing the state of the sheet cassette 2 from the storage state of the sheet having the minimum size to the storage state of the sheet having the A5 size and the storage state of the sheet having the maximum size, and extending the sheet cassette in a direction that increases the length of the sheet feeding direction will be described.

When the setting of the sheet cassette 2 is changed from the state where the minimum size specification is set to the storage state of the sheet having the A5 size, first, the operation portion 62 of the trailing end regulating lever 61 is thrown in either a forward direction or a backward direction. As a result, as described above, the second cam 65 of the trailing end regulating lever 61 lifts the second locking member 52, and locking of the second trailing end regulating member 5 with respect to the first trailing end regulating member 4 is released.

At this time, since the first trailing end regulating member 4 is locked to the cassette case 3, if the operation portion 62 of the trailing end regulating lever 61 is further moved in a backward direction, the second trailing end regulating member 5 is slid on the trailing end regulating plate and moved to the A5 storage position.

As such, if the second trailing end regulating member 5 moves to the A5 storage position, the third locking member 54 that has been moved integrally with the second trailing end regulating member 5 along the third locking releasing rib 38 is separated from the third locking releasing rib 38. Thereby, the third locking member 54 is engaged with the slit portion 67 by means of a downward pressing force of the third locking spring 55, and the first trailing end regulating member 4 and the second trailing end regulating member 5 are integrated with each other.

Figure 15:
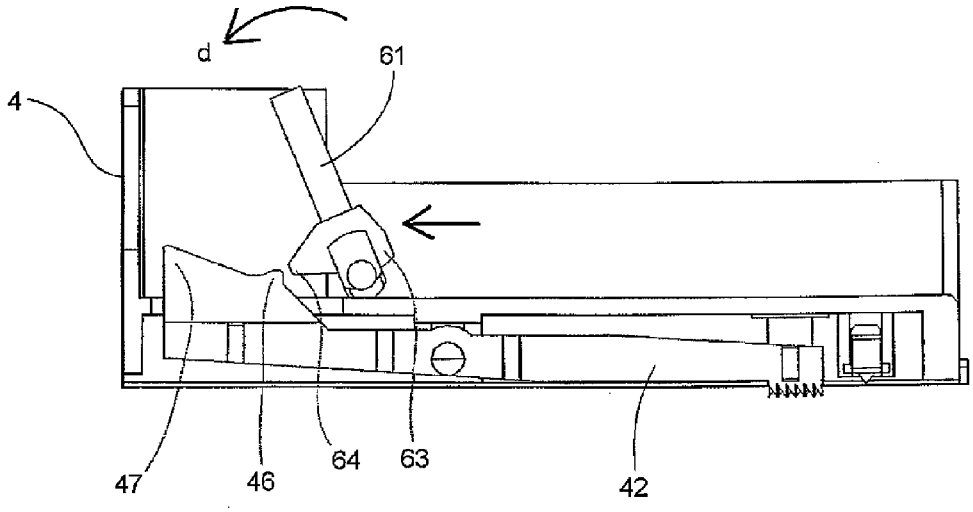
FIG. 15 is a diagram illustrating a state of the second trailing end regulating member immediately before reaching from a small size storage position to an A5 storage position.

Meanwhile, immediately before reaching the A5 storage position, as illustrated in FIG. 15, the first and second cams 63 and 64 of the trailing end regulating lever 61 approach the first and second locking cams 46 and 47 of the first locking member 42 such that they abut the first and second locking cams 46 and 47 from the separation state. At this time, the first and second cams 63 and 64 and the first and second locking cams 46 and 47 may bump each other.

That is, before the second trailing end regulating member 5 reaches the A5 storage position from the small size storage position, the first and second cams 63 and 64 of the trailing end regulating lever 61 and the first and second locking cams 46 and 47 of the first locking member 42 may bump each other. Further, it is difficult to avoid a collision in consideration of movement in a state where the trailing end regulating lever 61 is thrown as well as a disadvantage in component precision or a gap between the components.

In addition, in a state where the first and second cams 63 and 64 of the trailing end regulating lever 61 and the first and second locking cams 46 and 47 of the first locking member 42 bump each other, if the operation portion 62 of the trailing end regulating lever 61 is pushed, at the positions other than the set position, the first and second cams 63 and 64 may push the first and second locking cams 46 and 47 and push the first and second locking cams 46 and 47 in a downward direction.

In this case, as the first locking member 42 rocks, the first and second tooth rows 48 and 49 are separated from the first and second rack tooth rows 34 and 35 of the cassette case 3, and the state of the first trailing end regulating member 4 with respect to the cassette case 3 becomes a released state. In this state, if the trailing end regulating lever 61 is pushed, at the positions other than the set position, the first and second cams 63 and 64 may push the first and second locking cams 46 and 47 in both a downward direction and a backward direction.

As a result, before the second trailing end regulating member 5 reaches the A5 storage position, the first trailing end regulating member 4 may move in a large size storage direction. In addition, if the situation is generated, the first trailing end regulating member 4 and the second trailing end regulating member 5 may not be integrated with each other at the A5 size storage position.

For this reason, in this embodiment, when the first trailing end regulating member 4 is moved, the first trailing end regulating member 4 is elastically engaged with the cassette case 3, and the first trailing end regulating member 4 and the second trailing end regulating member 5 are integrated with each other, using a click member that applies a sense of click to the user.

In this case, when the first trailing end regulating member 4 is moved, as a member that applies a sense of click to the user, a trailing end click member 44 is provided as illustrated in FIG. 7, in this embodiment.

The trailing end click member 44 is used to apply a sense of click to the user, when the first trailing end regulating member 4 is moved to a storage position (trailing end regulation position) of a sheet having a standardized size. The trailing end click member 44 is restricted to the first trailing end regulating member 4 in a forward-to-backward direction. In addition, the trailing end click member 44 is mounted to move in an upward-to-backward direction. A trailing end click spring 45 pushes the trailing end click member 44 in a downward direction.

Further, in order to make the first trailing end regulating member 4 accurately held at the storage position of the sheet having the standardized size, as illustrated in FIG. 8, a plurality of concave portions 44*a*, each of which has a V shape corresponding to the V shape of the lower end of the trailing end click member 44, are formed in the cassette case 3. As such, the V shape of the lower end of the trailing end click member 44 and the concave portions on the cassette case side are engaged with each other and the first trailing end regulating member 4 is moved from the large size storage position to the A5 storage position, a sense of click can be applied to the user when the sheet having the standardized size is stored.

Figure 16A:
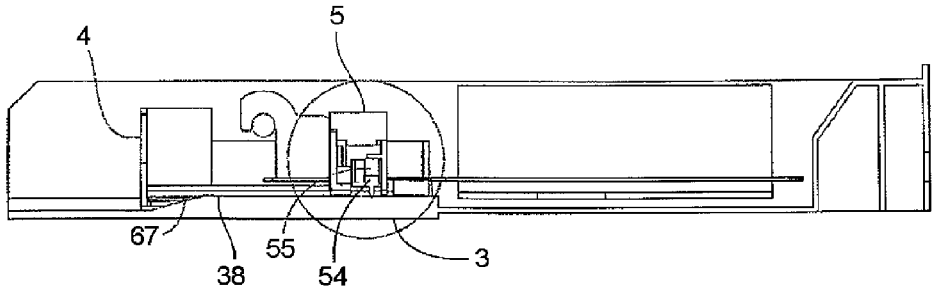
FIG. 16A is a diagram illustrating a state where the third locking member is fixed.
Figure 16B:
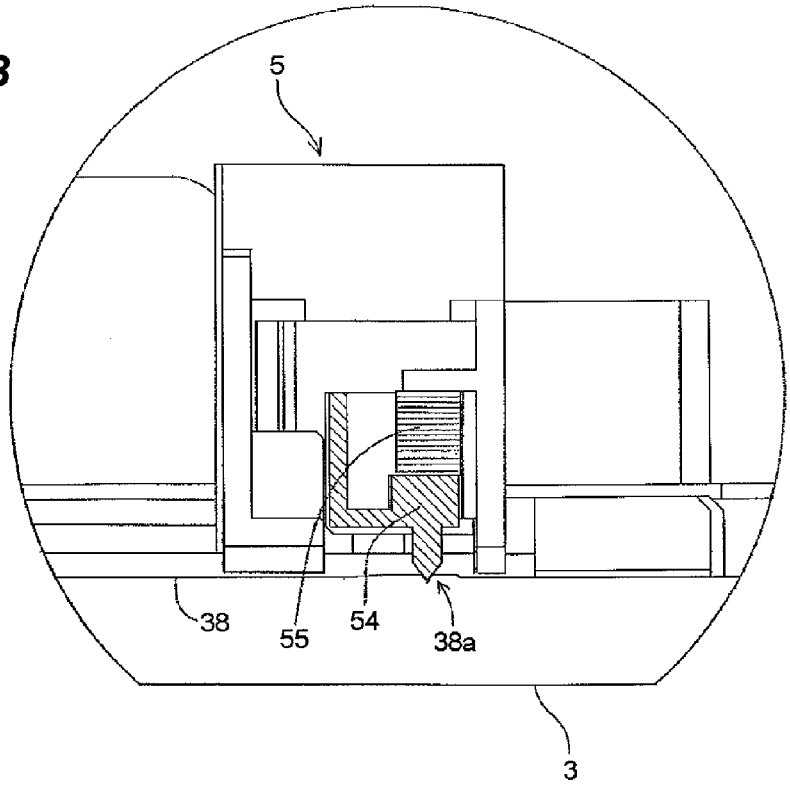
FIG. 16B is a partial enlarged view of FIG. 16A.

Meanwhile, when the sheet having the small size is stored, only the second trailing end regulating member 5 is moved. However, when the second trailing end regulating member is moved and the sheet having the standardized size is stored, the same sense of click is applied. For this reason, this embodiment uses the V shape of the lower end of the third locking member 54. As illustrated in FIG. 16, the concave portion 38*a* having the V shape that corresponds to the V shape of the lower end of the third locking member 54 is formed on the third locking releasing rib 38 of the cassette case 3.

In this case, when the second trailing end regulating member 5 is moved from the small size storage position to the A5 storage position, in order to prevent the first and second cams 63 and 64 and the first and second locking cams 46 and 47 from bumping each other, a sense of click of the first trailing end regulating member 4 at the A5 storage position is increased. For this reason, among the plurality of concave portions that are formed at the side of the cassette case, the shape of the concave portion that is engaged with the trailing end click member 44 at the A5 storage position is set to be different from the shapes of the other concave portions, thereby increasing resistance. In this way, it is possible to make the movement of the first trailing end regulating member 4 from the A5 storage position to the cassette case 3 difficult.

The engagement operation of the trailing end click member 44 is independent on the operation of the trailing end regulating member 61, and is performed even though engagement of the first and second tooth rows 48 and 49 of the first locking member 42 of the first trailing end regulating member 4 and the first and second rack tooth rows 34 and 35 of the cassette case 3 is released. For this reason, even though the first and second cams 63 and 64 and the first and second locking cams 46 and 47 bump each other, if the trailing end click member 44 is used, it is possible to make the first trailing end regulating member 4 not move from the A5 storage position. If the first trailing end regulating member 4 is not moved, the first and second trailing end regulating members 4 and 5 can be integrated by pushing the trailing end regulating lever 61.

Figure 17:
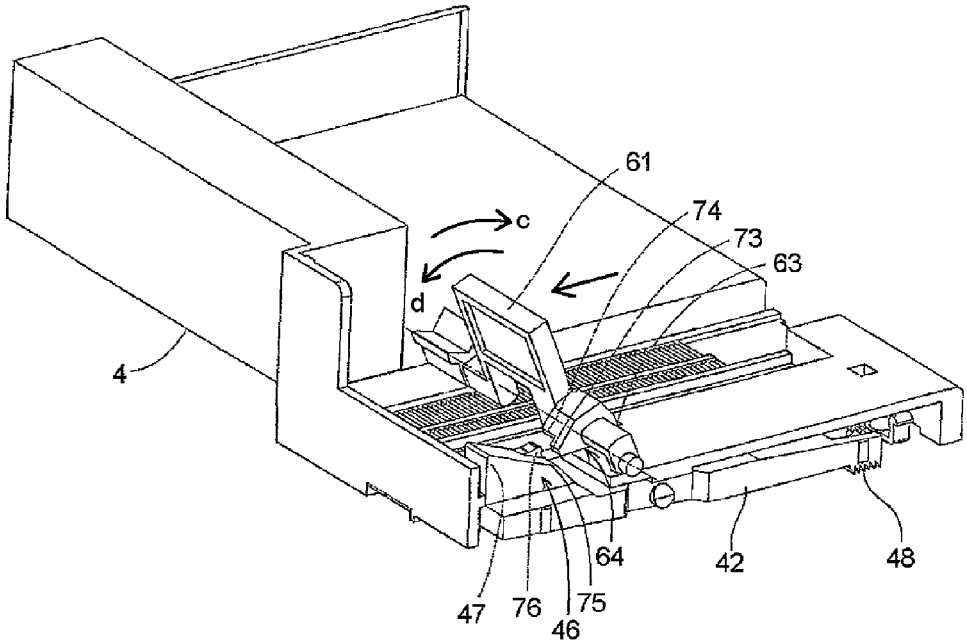
FIG. 17 is a diagram illustrating the configurations of first and second cams provided in the trailing end regulating lever and first and second locking cams provided in the first fixing mechanism.

In this embodiment, in order to integrate the first and second trailing end regulating members 4 and 5 with each other, as illustrated in FIG. 17, an angle of when the first and second cams 63 and 64 and the first and second locking cams 46 and 47 bump each other is decreased (with respect to a horizontal direction).

In this case, if the angle of when the first and second cams 63 and 64 and the first and second locking cams 46 and 47 bump each other is increased with respect to the horizontal direction, the first and second cams 63 and 64 may simultaneously push the first and second locking cams 46 and 47 in both a downward direction and a backward direction, when the first and second cams and the first and second locking cams bump each other. In this case, the first and second tooth rows 48 and 49 of the first locking member 42 are separated from the first and second rack tooth rows 34 and 35 of the cassette case 3. Further, the first trailing end regulating member 4 may be pushed in a backward direction, and the first trailing end regulating member 4 may move to the cassette case 3.

Accordingly, in order to prevent the first trailing end regulating member 4 from moving, an angle of when the first and second cams 63 and 64 of the trailing end regulating lever 61 and the first and second locking cams 46 and 47 bump each other is decreased. In this configuration, when the first and second cams 63 and 64 of the trailing end regulating lever 61 and the first and second locking cams 46 and 47 bump each other, the first and second cams 63 and 64 may push the first and second locking cams 46 and 47 in a downward direction. For this reason, the first and second tooth rows 48 and 49 of the first locking member 42 are separated from the first and second rack tooth rows 34 and 35 of the cassette case 3.

However, even though the first trailing end regulating member 4 is pushed in a backward direction, since the angle of when the first and second cams 63 and 64 of the trailing end regulating lever 61 and the first and second locking cams 46 and 47 bump each other is decreased, resistance is decreased. At this time, since the resistance is smaller than the resistance by the trailing end click member 44 at the A5 storage position of the above-described first trailing end regulating member 4, it is possible to make the movement of the first trailing end regulating member 4 from the A5 storage position to the cassette case 3 difficult.

Further, decreasing the angle of when the first and second cams 63 and 64 and the first and second locking cams 46 and 47 bump each other may be difficult from a relationship between first and second tooth rows 48 and 49 of the first locking member 42 and the first and second rack tooth rows 34 and 35 of the cassette case 3 in the separation amount.

For this reason, in this embodiment, as illustrated in FIG. 17, the second cam 64 and the first locking cam 46 are formed to have asymmetrical shapes at the left and right sides in a width-wise direction. In this case, the side end of the second cam 64 is used as a first cam portion 73 and the center side thereof is used as a second cam portion 74. Further, the side end of the first locking cam 46 is used as a first locking cam portion 75 and the center side thereof is used as a second locking cam portion 76. Further, the second cam portion 74 has a shape that is escaped from the first cam portion 73, and the first locking cam portion 75 has a shape that is escaped from the second locking cam portion 76.

FIG. 17 illustrates a state of when the trailing end regulating lever 61 is thrown in a d direction and the second trailing end regulating member 5 is moved from a small size storage position to an A5 storage position. At this time, as illustrated in FIG. 17, since the second cam portion 74 of the second cam 64 of the trailing end regulating lever 61 has an escaped shape, it is possible to decrease an angle of when the second cam portion of the second cam of the trailing end regulating lever and the cam shape of the second locking cam portion 76 of the first locking cam 46 bump each other. Alternatively, the bumping can be avoided. Further, since the first locking cam portion 75 of the first locking cam 46 has an escaped shape, it is possible to decrease the angle of when the second cam 64 and the cam shape of the first cam portion 73 bump each other or avoid the bumping.

As such, even though the cam shapes are asymmetrical shapes at the left and right sides and the escaped shape is added, the shapes of the first cam portion 73 of the second cam 64 and the second locking cam 47 of the first locking member 42, and the shapes of the first cam 63 and the second locking cam portion 76 of the first locking cam 46 are the same as the shapes described above. For this reason, when the first trailing end regulating member 4 and the second trailing end regulating member 5 are integrated with each other, the cam relationship is not collapsed, and the normal operation is enabled.

Meanwhile, when the trailing end regulating lever 61 is thrown in a c direction and the second trailing end regulating member 5 is moved from the small size storage position to the A5 storage position, the angle of when the first and second cams 63 and 64 of the trailing end regulating lever 61 and the first and second locking cams 46 and 47 bump each other is decreased. For this reason, it becomes difficult for the first trailing end regulating member 4 to move from the A5 storage position to the cassette case 3.

As described above, since the second cam 64 and the first locking cam 46 have asymmetrical cam shapes at the left and right sides in a width-wise direction, the first trailing end regulating member 4 and the second trailing end regulating member 5 can be smoothly integrated with each other.

Meanwhile, in this embodiment, the body 4A of the first trailing end regulating member 4 and the body 51 of the second trailing end regulating member 5 are provided with bump surfaces 4A1 and 5A1 that bump the sheet at the time of storing the sheet illustrated in FIG. 2. In addition, in the storage state of the small size sheet where the first and second trailing end regulating members 4 and 5 are separated from each other, the trailing end of the sheet bumps only the bump surface 5A1 of the second trailing end regulating member 5 that bumps the sheet.

However, in the storage state of the large size sheet including the sheet having the A5 size where the first and second trailing end regulating members 4 and 5 are integrated with each other, the second trailing end regulating member 5 is disposed such that the bump surface 5A1 thereof is escaped from the trailing end of the sheet from the bump surface 4A1 of the first trailing end regulating member 4. As a result, the trailing end of the sheet bumps only the bump surface 4A1 of the first trailing end regulating member 4.

By this configuration, in the case of the large size sheet, the bump surface 4A1 of the first trailing end regulating member 4 whose width length is longer than that of the second trailing end regulating member 5 can actively bump the trailing end of the sheet. As a result, it is possible to remove the deviation of the storage position of the sheet, that is, the inclination or the deviation from the sheet feeding direction, which results in preventing skew feeding at the time of feeding the sheet.

As described above, according to this embodiment, the user operates one trailing end regulating lever 61, thereby releasing holding of the trailing end regulation positions of the first and second trailing end regulating members 4 and 5 and moving the first and second trailing end regulating members 4 and 5 to the trailing end regulation positions according to the size of the stored sheet. As a result, it is possible to improve usability.

Next, a second embodiment of the present invention will be described.

Figure 18:
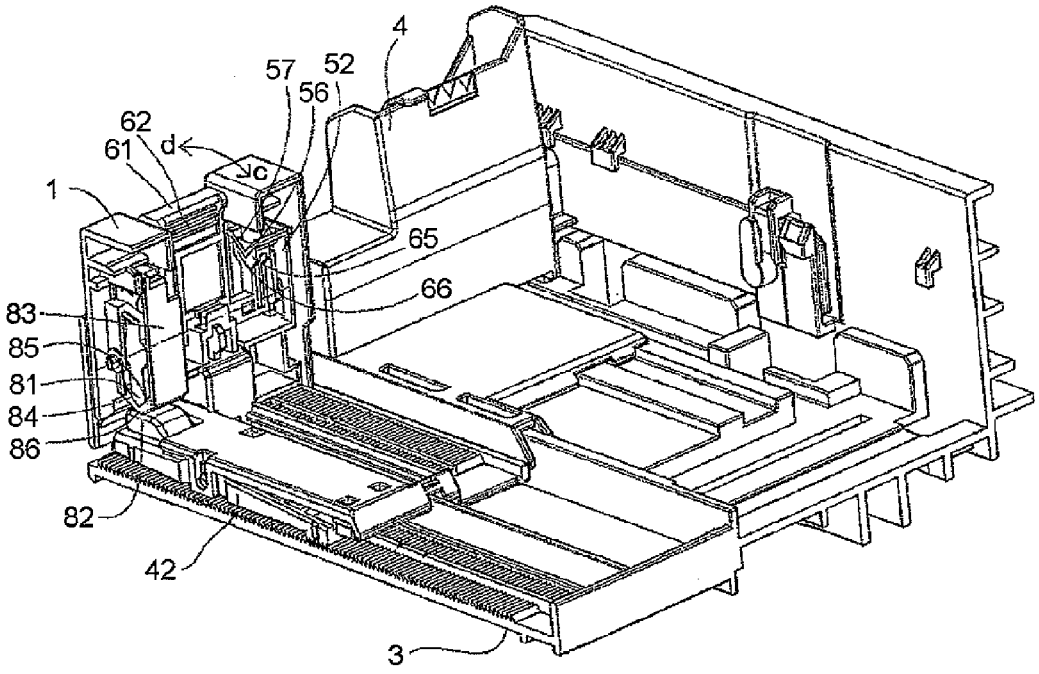
FIG. 18 is a diagram illustrating the configuration of a sheet cassette that is provided in an image forming apparatus including a sheet feeding apparatus according to a second embodiment of the present invention.

FIG. 18 is a diagram illustrating the configuration of a sheet cassette provided in an image forming apparatus including a sheet feeding apparatus according to this embodiment. Further, in FIG. 18, the same components as those in FIG. 11 are denoted by the same reference numerals.

In this embodiment, in order to increase the sheet storage capacity of the sheet cassette 2, the heights of the first and second trailing end regulating members 4 and 5 are increased. As such, if the height of the second trailing end regulating member 5 is increased, the position of the rotation center of the trailing end regulating lever 61 becomes higher. If the position of the rotation center of the trailing end regulating lever 61 becomes higher, a rotation angle is decreased, even though the trailing end regulating lever 61 is operated.

As a result, the configuration where the first cam 63 and the second cam 64 that are provided in the trailing end regulating lever 61 push the first locking cam 46 and the second locking cam 47 of the first locking member 42 corresponding to the first cam 63 and the second cam 64 may not be proper. As a result, it may not possible to release locking of the first trailing end regulating member 4.

Figure 19:
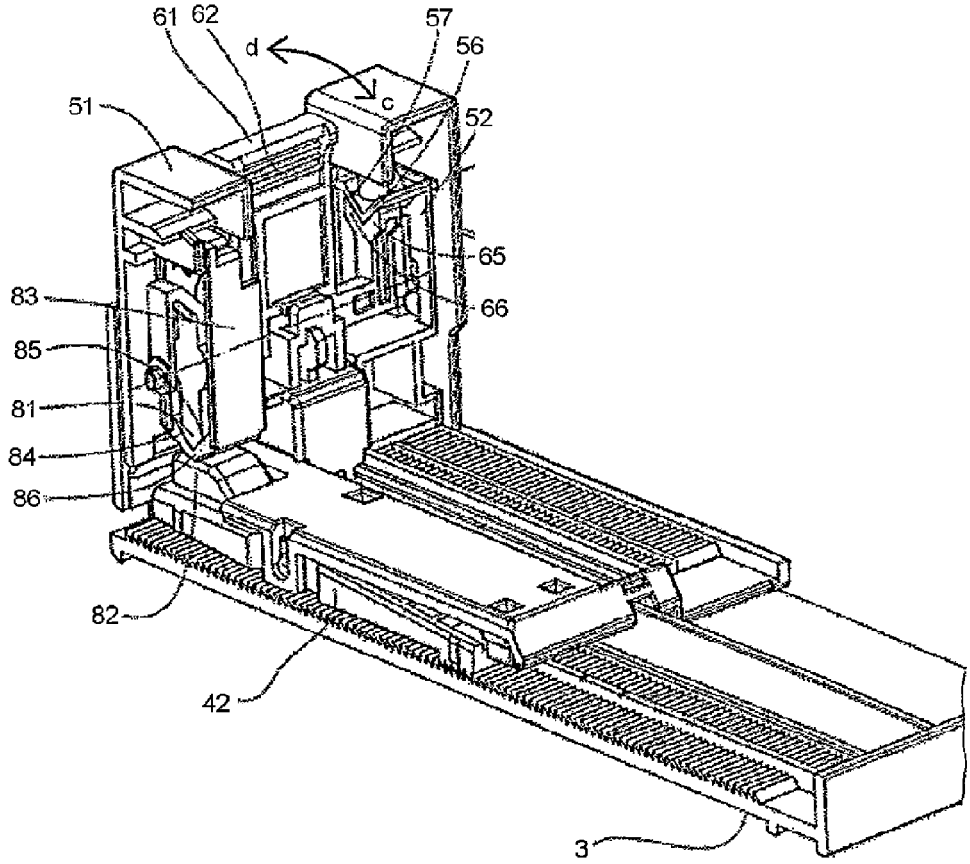
FIG. 19 is an enlarged view of a main portion of the sheet cassette.

Accordingly, in this embodiment, as illustrated in FIG. 19, a fifth locking cam 82 is provided in the first locking member 42 that is rotatably mounted in the first trailing end regulating member 4. Further, a link cam member 83 is provided in the second trailing end regulating member 5 to move in an upward-to-downward direction. The link cam member 83 serves as a link member that is located between the trailing end regulating lever 61 and the first locking member 42 and transmits the operation of the trailing end regulating lever 61 to the first locking member 42.

In this case, the link cam member 83 has a first link cam 84 and a second link cam 85 that correspond to the first cam 81 of the trailing end regulating lever 61. Further, the link cam member 83 has a third link cam 86 that corresponds to the first locking cam 82 of the first locking member 42.

Figure 20:
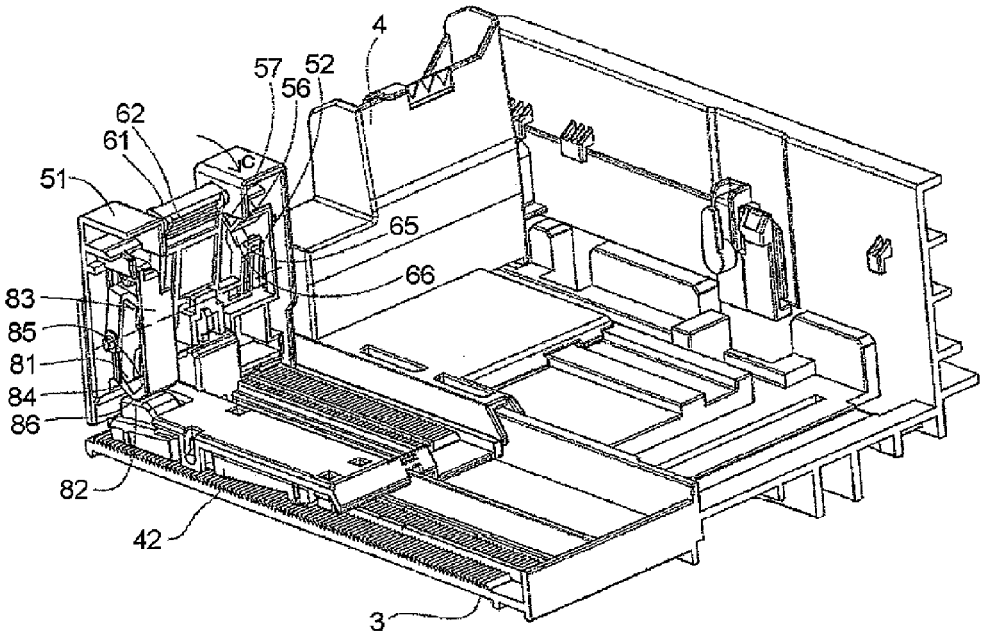
FIG. 20 is a diagram illustrating a state of when an operation portion of a trailing end regulating lever, which is provided in a second trailing end regulating member of the sheet cassette, is thrown in a direction illustrated by an arrow c.

In addition, as illustrated in FIG. 20, if the user throws the operation portion 62 of the trailing end regulating lever 61 in a c direction, since the first cam 81 provided in the trailing end regulating lever 61 rotates and pushes in the second link cam 85, the link cam member 83 moves in a downward direction. As a result, the third link cam 86 pushes the first locking cam 82.

Figure 21:
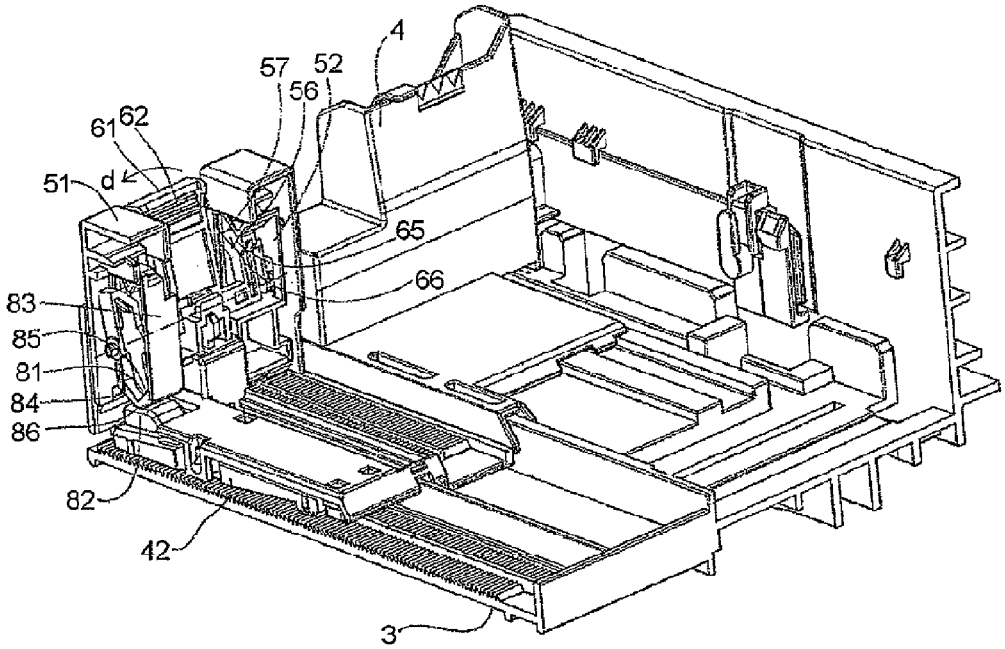
FIG. 21 is a diagram illustrating a state of when an operation portion of a trailing end regulating lever, which is provided in the second trailing end regulating member, is thrown in a direction illustrated by an arrow d.
Figure 22:
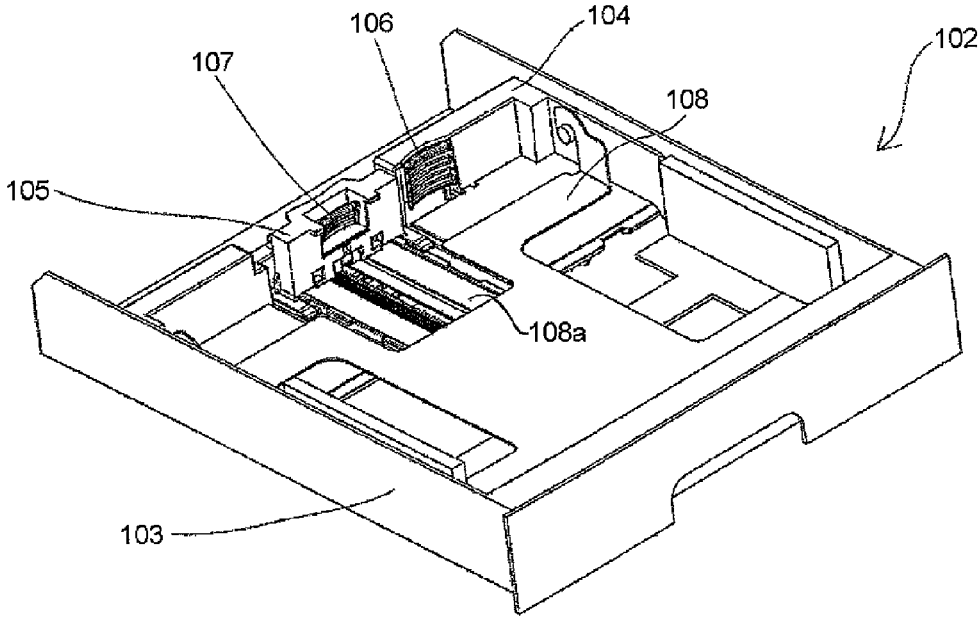
FIG. 22 PRIOR ART
FIG. 22 is a perspective view illustrating an expanding/contracting sheet cassette according to the related art.
Figure 23A:
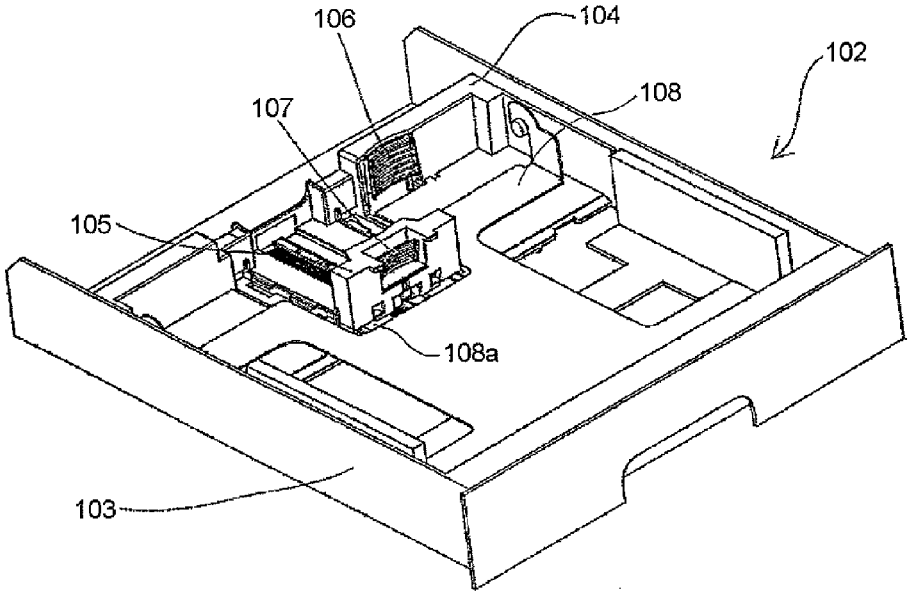
FIG. 23A PRIOR ART
FIG. 23A is a diagram illustrating a position of a second trailing end regulating member when a sheet is stored in the sheet cassette according to the related art.
Figure 23B:
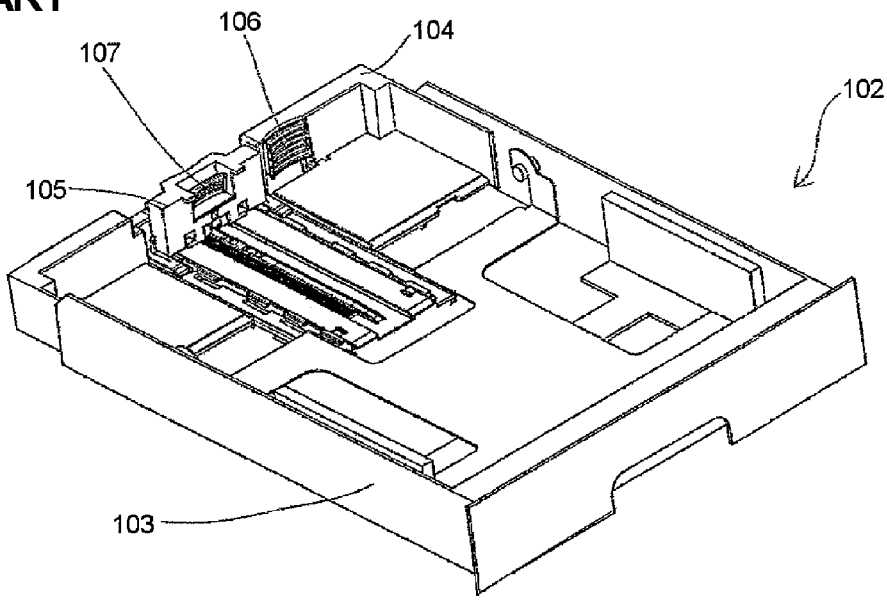
FIG. 23B PRIOR ART
FIG. 23B is a diagram illustrating a position of a second trailing end regulating member when a sheet is stored in the sheet cassette according to the related art.

As illustrated in FIG. 21, similar to the above case, if the user throws the operation portion 62 of the trailing end regulating lever 61 in a d direction, since the first cam 81 provided in the trailing end regulating lever 61 rotates and pushes in the first link cam 84, the link cam member 83 moves in a downward direction. As a result, the third link cam 86 pushes the first locking cam 82.

As a result, even in the case where the link cam member 83 is used, it is possible to release locking of the first trailing end regulating member 4 with respect to the cassette case 3 by the first locking member 42, regardless of whether the user throws the operation portion 62 of the trailing end regulating lever 61 in a c direction or a d direction.

As in this embodiment, if the link cam member 83 is used, by the operation of the trailing end regulating lever 61, holding of the trailing end regulation positions of the first and second trailing end regulating members 4 and 5 can be released and the first and second trailing end regulating members 4 and 5 can be moved to the trailing end regulation positions according to the size of the stored sheet. As a result, in order to store the large amount of sheets, the sheet stacking height is increased. Accordingly, even when the height of the second trailing end regulating member 5 is increased, it is possible to improve usability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus, comprising:

a sheet cassette;

a sheet feeding apparatus configured to feed a sheet stored in the sheet cassette; and an image forming portion configured to form an image on the sheet transmitted by the sheet feeding apparatus, wherein the sheet cassette includes:

a cassette body configured to store the sheet, a first regulating member that is provided in the cassette body, is configured to be slid in a forward-to-backward direction, and is configured to regulate a trailing end of the sheet stored in the cassette body, a second regulating member that is provided in the first regulating member, is configured to be slid in a forward-to-backward direction, and is configured to regulate the trailing end of the sheet stored in the cassette body, a first holding portion that engages a first engagement unit provided in the cassette body and is configured to hold the first regulating member and the cassette body, a second holding portion that engages a second engagement unit provided in the first regulating member and is configured to hold the first regulating member and the second regulating member, a releasing portion that includes a single operation lever that is configured to release both holding of the first holding portion and holding of the second holding portion in response to an operation of the operation lever, a connecting portion configured to connect the first regulating member and the second regulating member for integral movement, and a connection releasing member configured to release a connection of the first regulating member and the second regulating member, wherein, in a connected state of the connecting portion, the releasing portion is configured to release holding of the first holding portion by the operation of the operation lever, and wherein, in a released state of the connection releasing member, the releasing portion is configured to release holding of the second holding portion by the operation of the operation lever.

2. The image forming apparatus according to claim 1, wherein the releasing portion includes:

a first holding releasing portion configured to release holding of the first regulating member by the first holding portion, and a second holding releasing portion configured to release holding of the second regulating member by the second holding portion.

3. The image forming apparatus according to claim 2, wherein each of the first holding releasing portion and the second holding releasing portion of the releasing portion includes two cam portions that are provided along a sheet feeding direction, and the two cam portions of each of the first holding releasing portion and the second holding releasing portion are provided at positions that enable holding of the first regulating member and the second regulating member to be simultaneously released.

4. The image forming apparatus according to claim 1, wherein the connection releasing member is configured to release the connection of the connecting portion such that only the second regulating member is slid, when the trailing end of the sheet having a size smaller than a predetermined size is regulated.

5. The image forming apparatus according to claim 4, wherein the connecting portion includes an inserting portion having a protrusion shape that is configured to be provided in the second regulating member and a slit portion that is configured to be provided in the first regulating member and have the inserting portion inserted therein, and the connecting portion is configured to connect the first regulating member and the second regulating member by inserting the inserting portion into the slit portion.

* * * * *